US006258134B1

(12) United States Patent
Studzinski et al.

(10) Patent No.: US 6,258,134 B1
(45) **Date of Patent: *Jul. 10, 2001**

(54) HIGH OCTANE UNLEADED AVIATION GASOLINES

(75) Inventors: William M. Studzinski, Wappingers Falls; Joseph N. Valentine, Newburgh; Peter Dorn, Lagrangeville, all of NY (US); Teddy G. Campbell, Brookfield; Peter M. Liiva, Greenwich, both of CT (US)

(73) Assignee: Texaco Inc., White Plains, NY (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

This patent is subject to a terminal disclaimer.

(21) Appl. No.: 09/217,473

(22) Filed: Dec. 21, 1998

Related U.S. Application Data

(63) Continuation of application No. 08/856,019, filed on May 14, 1997, now Pat. No. 5,851,241.

(60) Provisional application No. 60/018,624, filed on May 24, 1996.

(51) Int. Cl.[7] ..... C10L 1/18; C10L 1/22; C10L 1/30

(52) U.S. Cl. ..... 44/359; 44/426; 44/449

(58) Field of Search ..... 44/359, 426, 354, 44/449

(56) References Cited

U.S. PATENT DOCUMENTS 2,819,953 * 1/1958 Brown et al. .
4,233,035 * 11/1980 Allen et al. .
4,396,398 * 8/1983 Knight .
4,405,338 * 9/1983 Jenkins .
4,690,687 * 9/1987 Johnston et al. ..... 44/433
5,470,358 * 11/1995 Gaughan ..... 44/426
5,484,463 * 1/1996 Cherpeck ..... 44/387
5,514,190 * 5/1996 Cunningham et al. ..... 44/415
5,516,342 * 5/1996 Cherpeck ..... 44/347
5,851,241 * 12/1998 Studzinski et al. ..... 44/359

FOREIGN PATENT DOCUMENTS

WO94/25545 * 11/1994 (WO) .

OTHER PUBLICATIONS

Derwent Abstract (AN 97–098600) referring to Russian patent RU2061736 (Jun. 10, 1996) and Russian patent application RU940017595 (May 11, 1994) (Achinsk Oil Refinery Stock Co).

English–language translation of Russian patent document RU2061736 (Jun. 10, 1996) (Achinsk Oil Refinery Stock Co.).

Valentine et al., "Developing a High Octane Unleaded Aviation Gasoline," *SAE International Meeting & Exposition* (1997) Month Unknown.

Database WPI, Derwent Abstract No. 97–098600, for patent document assigned to Achinsk Oil Refinery Stock Co., entitled "Hydrocarbon Composition for IC Engine with Spark Ignition Containing (Alpha–hydroxy–isopropyl)ferrocene, Methyl–t–butyl ether and/or N–methyl aniline and Hydrocarbon Fuel Giving Reduced Octane Number.".

* cited by examiner

*Primary Examiner*—Margaret Medley
(74) *Attorney, Agent, or Firm*—Morris N. Reinisch; Howrey Simon Arnold & White

(57) ABSTRACT

Novel aviation fuel compositions contain a substantially positive or synergistic combination of an alkyl tertiary butyl ether, an aromatic amine and, optionally, a manganese component. The basefuel containing the additive combination may be a wide boiling range alkylate basefuel.

20 Claims, 30 Drawing Sheets

HIGH OCTANE UNLEADED AVIATION GASOLINES

This application is a continuation of U.S. application Ser. No. 08/856,019, filed May 14, 1997, which issued as U.S. Pat. No. 5,851,241 on Dec. 22, 1998, which claims the benefit of U.S. Provisional Application No. 60/018,624 filed May 24, 1996.

BACKGROUND OF THE INVENTION

The invention relates generally to aviation gasoline (Avgas) compositions and methods of making and using such compositions. More particularly, the present invention concerns high octane Avgas compositions containing a non-leaded additive package and methods of making and using such compositions.

Conventional aviation gasoline (Avgas) generally contains an aviation alkylate basefuel and a lead-based additive package. The industry standard Avgas known as 100 Low Lead (100LL) contains the lead additive tetraethyllead (TEL) for boosting the anti-knock property of the Avgas over the inherent anti-knock property of its aviation alkylate basefuel. Knocking is a condition of piston-driven aviation engines due to autoignition, the spontaneous ignition of endgases (gases trapped between the cylinder wall and the approaching flame front) in an engine cylinder after the sparkplug fires. A standard test that has been applied to measure the anti-knock property of lead-based Avgas under various conditions is the motor octane number (MON) rating test (ASTM D2700). Another standard test applied to lead-based Avgas is the supercharge (performance number) rating test (ASTM D909).

Despite the ability of lead-based Avgas to provide good anti-knock property under the severe demands of piston-driven aviation engines, such lead-based compositions are meeting stricter regulations due to their lead and lead oxide emissions. Current U.S. regulations set a maximum amount of TEL for aviation fuels at 4.0 ml/gal and concerns for the negative environmental and health impact of lead and lead oxide emissions may effect further restrictions. Gaughan (PCT/US94/04985, U.S. Pat. No. 5,470,358) refers to a no-lead Avgas containing an aviation basefuel and an aromatic amine additive. The Avgas compositions exemplified in Gaughan reportedly contain an aviation basefuel (e.g., isopentane, alkylate and toluene) having a MON of 92.6 and an alkyl- or halogen-substituted phenylamine that boosts the MON to at least about 98. Gaughan also refers to other non-lead octane boosters such as benzene, toluene, xylene, methyl tertiary butyl ether, ethanol, ethyl tertiary butyl ether, methylcyclopentadienyl manganese tricarbonyl and iron pentacarbonyl, but discourages their use in combination with an aromatic amine because, according to Gaughan, such additives are not capable by themselves of boosting the MON to the 98 level. Gaughan concludes that there is little economic incentive to combine aromatic amines with such other additives because they would have only a very slight incremental effect at the 98 MON level.

It would be desirable to find alternative Avgas compositions that avoid the use of lead-based additives and have good performance in piston-driven aviation engines. It would also be desirable to find Avgas compositions that could use less expensive basefuels.

SUMMARY OF THE INVENTION

The Avgas compositions of the invention contain a combination of non-lead additives (also referred to as the "additive package") including an alkyl tertiary butyl ether and an aromatic amine. The additive package may further include manganese, for example, as provided by methyl cyclopentadienyl manganese tricarbonyl (MT). In a preferred embodiment, the substantially positive or synergistic additive package is combined with a wide boiling range alkylate basefuel. In a further preferred embodiment, the inventive Avgas composition is an unleaded Avgas having good performance in a piston-driven aviation engine as determined by one or more ratings including MON, Supercharge and Knock Cycles/Intensity at maximum potential knock conditions of an aviation engine.

The invention is also directed to a method of making an unleaded Avgas composition wherein the additive package is combined with a basefuel, such as a wide boiling range alkylate. The concentration of the additives in the Avgas may be based on a non-linear model, wherein the combination of additives has a substantially positive or synergistic effect on the performance of the unleaded Avgas composition. The invention is further directed to a method of improving aviation engine performance by operating a piston-driven aviation engine with such Avgas compositions.

DESCRIPTION OF ILLUSTRATIVE EMBODIMENTS

Figure 1:
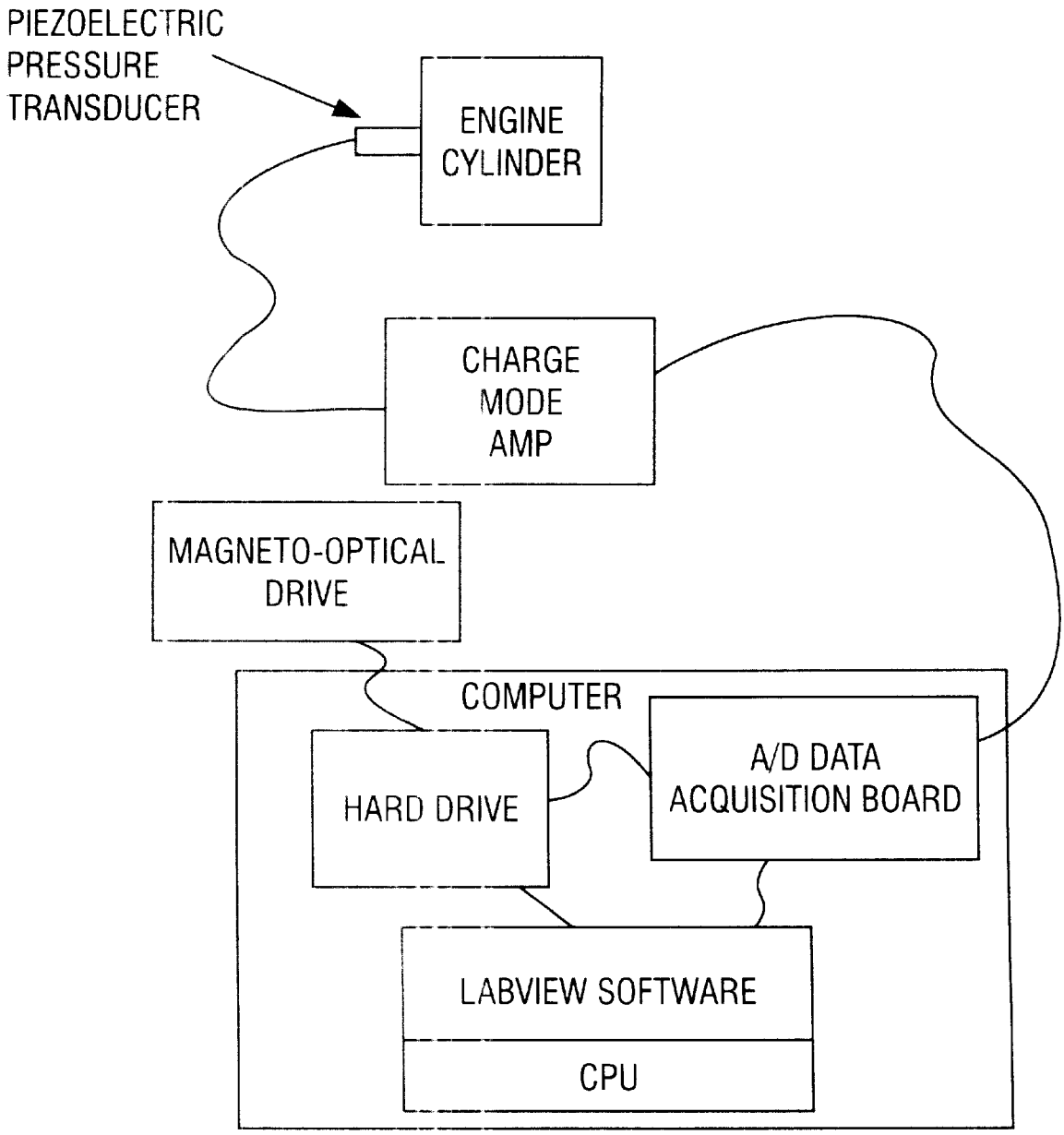
FIG. 1 is a diagram of the experimental setup of determining Knock Cycles and Intensity Rating as described in the Examples, Section C.

For purposes of the invention, "Avgas" or "Avgas composition" refers to an aviation gasoline. In general, an Avgas is made of a basefuel and one or more additives.

The compositions according to the invention contain a combination of additives including an alkyl tertiary butyl ether and an aromatic amine. The combination may further include a manganese component that is compatible with the other additives and the base fuel, for example, as provided by the addition of methyl cyclopentadienyl manganese tricarbonyl (MMT). The combination of additives is also referred to as "the additive package."

The alkyl tertiary butyl ether in the additive package is preferably a $C_1$ to $C_5$ tertiary butyl ether and more preferably methyl tertiary butyl ether (MTBE) or ethyl tertiary butyl ether (ETBE). This component of the additive package is also broadly referred to as the oxygenate.

The aromatic amine in the additive package is preferably of the formula:

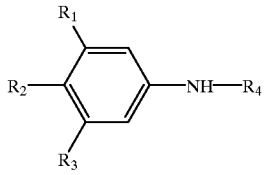

where $R_1$, $R_2$, $R_3$ and $R_4$ are individually hydrogen or a $C_1$–$C_5$ alkyl group. In a preferred embodiment, the aromatic amine additive is aniline, n-methyl aniline, n-ethyl aniline, m-toluidine, p-toluidine, 3,5-dimethyl aniline, 4-ethyl aniline or 4-n-butyl aniline.

Methyl cyclopentadienyl manganese tricarbonyl (MMT) may also be included in the additive package, particularly to provide a magnesium component to the additive package.

The inventive Avgas compositions preferably comprise 0.1 to 40 vol % alkyl tertiary butyl ether, 0.1 to 10 wt % aromatic amine and 0 to 0.5 g per gal manganese. For example, the inventive composition may comprise 15 to 32 vol % methyl tertiary butyl ether, 1.5 to 6 wt % aniline and 0 to 0.1 g per gal manganese (or further preferably 0.1 to 0.5 g per gal manganese).

In a preferred embodiment, the additive package has a substantially positive or synergistic effect in the Avgas composition to which it is added. For purposes of this specification, the term "substantially positive," in the context of the additive package, means that a successive additive that is added to the Avgas composition substantially boosts the performance of the Avgas composition. In the case of MON, "substantially positive" effect means that each successive additive boosts the Avgas MON, preferably by 0.5, more preferably by 1.0 and most preferably by 1.5. For example, an Avgas containing a wide boiling range alkylate having a MON of 91.5 and an additive of 10 wt % aniline has a MON of 97.6. When that Avgas further contains a 40 vol % ETBE, the Avgas MON is boosted to 101.1. Such a composition contains a substantially positive combination of additives because the overall MON of 101.1 is greater than the individual MON levels of 97.6 (10 wt % aniline) and 96.2 (40 vol % ETBE) and the addition of 40 vol % ETBE boosted the MON of the basefuel/10 wt % aniline composition by 3.5.

For purposes of this specification, the term "synergistic," in the context of the additive package, means that the effect of the combined additives is greater than the sum of the performance achieved by the individual additives under the same conditions. In the case of MON, synergistic means that the increase in MON due to the additive package is greater than the sum of MON increases for each additive when it is the sole additive in the basefuel.

These definitions of "substantially positive" and "synergistic" effect are further understood in view of the numerous combinations of additives that result only in antagonistic combinations, wherein the overall MON does not increased or decreases with the addition of other additives.

Combining multiple additives into a package that includes an aromatic amine has been viewed as an undesirable approach to improve the anti-knock property of an Avgas. (See Background of the Invention, Gaughan.) As further shown in the following Table 1, random mixtures of multiple octane boosting additives can result in antagonistic octane effects.

TABLE 1

Non-linear Blending Octane Effects
(Basefuel is wide boiling range alkylate.)

| Blend # | ETBE (vol %) | Mn (g/gal) | Aniline (wt. %) | MON |
|---|---|---|---|---|
| 1 | 0 | 0 | 10 | 97.6 |
| 2 | 40 | 0 | 0 | 96.2 |
| 3 | 40 | 0 | 10 | 101.1 |
| 4 | 40 | 0.5 | 10 | 97.9 |

Legend: ETBE = Ethyl Tertiary Butyl Ether, Mn = Manganese Concentration*, MON = Motor Octane *as provided by a corresponding amount of MMT As seen in Blend #4, the combination of basefuel/10% wt aniline/40 vol % ETBE/0.5 g/gal manganese results in an antagonistic effect wherein the additive package (40 vol % ETBE/0.5 g/gal Mn/10 wt % aniline) does not boost the MON beyond that of the basefuel to any significant extent. Indeed, this additive package reduces the MON boosting effect of the basefuel/10% wt aniline/40% vol ETBE composition.

In a preferred embodiment, the additive package is combined with a basefuel containing a wide boiling range alkylate. Under this embodiment of the invention, an Avgas can be made with a basefuel not conventionally used for Avgas. Under aviation standards (ASTM D-910), the basefuel in an Avgas is an aviation alkylate, which is a specially fractionated hydrocarbon mixture having a relatively narrow range of boiling points. The inventive additive package may be added to any suitable basefuel wherein the resulting combination of additive package and basefuel is suitable for use as an Avgas, as based on performance characteristics and ratings and not necessarily on ASTM standards. Such basefuels include conventional aviation alkylates (e.g. within the specifications of ASTM-910, including specifications for boiling points and distillation temperatures) and wide boiling range basefuels.

For purposes of this specification, the term "wide boiling range alkylate" is defined as an alkylate containing components having a range of boiling points that is substantially wider than the range of boiling points in an aviation alkylate basefuel. Preferably, the wide boiling range alkylate contains hydrocarbons having a range of boiling points up to at least about 350° F. More preferably, the boiling range is from about 85° F.±10° F. to about 400° F.±15° F. (which essentially corresponds to an automotive gasoline basefuel). The following Table 2 provides an example of an aviation alkylate and a wide boiling range alkylate.

TABLE 2

Comparison of Wide boiling Range Alkylate and Aviation Alkylate Fuels.

| Tests | Wide boiling range alkylate | Aviation Alkylate |
|---|---|---|
| | Distillation Results | |
| IBP* | 88.1° F. | 97.7° F. |
| 10% | 147.9 | 155.3 |
| 20% | 179.4 | 178.5 |
| 30% | 199.2 | 195.8 |
| 40% | 209.8 | 206.0 |
| 50% | 216.6 | 212.1 |
| 60% | 222.4 | 215.7 |
| 70% | 228.7 | 218.6 |
| 80% | 238.6 | 221.3 |
| 90% | 262.9 | 224.9 |
| FBP* | 397.2 | 233.4 |
| API | 71.5 | 73.0 |
| RVP | 7.6 psi | 6.5 psi |
| Paraffins | 99.2 vol. % | 99.4 vol. % |
| Olefins | 0.2 vol. % | 0.4 vol. % |
| Aromatics | 0.6 vol. % | 0.2 vol. % |
| MON | 91.4 | 93.9 |
| RON | 93.4 | 97.1 |
| Perf. No. | 85.4 | 97.4 |

Legend: IBP = Initial Boiling Point, EBP = Final Boiling Point, API = API Gravity, RVP = Reid Vapor Pressure @ 100F., RON = Research Octane Number, MON = Motor Octane Number, Perf. No. = Performance Number (ASTM - D909)

The lower octane of the wide boiling range alkylate compared to the aviation alkylate is due primarily to lower amounts of inherently high octane hydrocarbons, isopentane and isooctane, as well as higher amounts of higher molecular weight, higher boiling paraffins. Table 3 presents gas chromatographic analyses of the aviation industry standard 100 Low Lead, which uses aviation alkylate as the primary base stock (e.g., at least 88% vol) and the wide boiling range alkylate and demonstrates the lower concentrations of isopentane and the isooctane isomers in the wide boiling range alkylate.

TABLE 3

Comparison of Wide Boiling Range Alkylate and 100 Low Lead

| | Concentration in 100 Low Lead (wt %) | Concentration in Wide Boiling Range Alkylate (wt %) |
|---|---|---|
| Isopentane | 9.26 | 5.04 |
| 2,2,4-trimethylpentane | 30.93 | 21.89 |
| 2,2,3-trimethylpentane | 1.06 | 1.40 |
| 2,3,4-trimethylpentane | 9.91 | 10.99 |

The distillation curve temperatures for the second half of the wide boiling range alkylate are considerably higher than the aviation alkylate because of the higher molecular weight paraffinic hydrocarbons present in the former.

A common result of having a higher concentration of larger paraffins, particularly with the straight chain or normal paraffins, is a lower octane value. The larger paraffin molecules present in the wide boiling range alkylate typically undergo more and faster isomerization chemical reaction steps during the low temperature portion of the oxidation chemistry leading to auto-ignition. Isomerization steps in paraffin chemistry are very fast routes to free radical propagation and subsequent autoignition. The oxidation steps leading to autoignition between the two alkylate basefuels are different thus requiring different fuel and additive formulations for optimal performance. Substituting high octane oxygenates for a substantial proportion of the alkylate basefuel reduces the number of rapid isomerization reactions and replaces them with less reactive partial oxidation intermediates, thereby increasing the octane value of the fuel.

The preferred embodiment of the invention that uses the wide boiling range alkylate as a basefuel offers a high quality, high performance alternative to conventional Avgas. Such wide boiling range alkylate basefuels offer a greater choice of basestocks for Avgas formulations and also likely provide a less expensive basefuel for Avgas compared to the conventional aviation alkylate basefuel.

In a preferred embodiment, the compositions according to the invention have good performance in piston-driven aviation engines. Preferably that performance is determined by one or more ratings including MON, Supercharge and Knock Cycles/Intensity at maximum potential knocking conditions in an aircraft engine. The inventive Avgas compositions preferably have a MON of at least about 94, more preferably at least about 96 and most preferably at least about 98. Further preferred Avgas compositions have a MON of at least about 99 or more preferably at least about 100. For example, a preferred MON range may be from about 96 to about 102. The Supercharge rating is preferably at least about 130. The inventive Avgas compositions also preferably minimize, or eliminate, knocking in a piston-driven aircraft engine at maximum potential knocking conditions. The Knock Cycle rating is preferably less than (average) 50 per 400 cycles and the Knock Intensity rating is preferably less than 30 per cycle.

The invention is also directed to a method for preparing an Avgas composition that involves combining a basefuel, such as a wide boiling range alkylate, with an additive package. The content and concentration of the additive package is preferably selected from an inventive non-linear model that identifies substantially positive or synergistic additive packages. The method preferably identifies Avgas compositions that have good performance in piston-driven aviation engines based on ratings of MON, Supercharge and/or Knock Cycles/Intensity.

The invention is further directed to a method for operating a piston-driven aircraft that involves operating the piston-driven engine with an Avgas composition made by a composition according to the invention.

EXAMPLES

A. Determination of MON

The MON rating test (ASTM D2700) is conducted using a single cylinder variable-compression laboratory engine which has been calibrated with reference fuels of defined octane levels. The sample of interest is compared to two reference fuels at standard knock intensity and the octane number of the sample is determined by bracketing or compression ratio (c.r.) methods. In bracketing, the octane value of the sample is determined by interpolating between two reference fuel octane values. In the c.r. method, the octane value of the sample is determined by finding the compression ratio which duplicates the standard knock intensity of a reference fuel and the octane number is then found in a table of values. Repeatability limits for MON determination at 95% confidence intervals is 0.3 MON for 85–90 MON fuels while reproducibility limits are 0.9 for 85 MON and 1.1 for 90 MON.

B. Determination of Supercharge Rating

The Supercharge rating test (ASTM-D909) determines the knock-limited power, under supercharge rich-mixture conditions, of fuels for use in spark ignition reciprocating aircraft engines. The Supercharge rating is an industry standard for testing the severe octane requirements of piston driven aircraft. For purposes of this application, "ASTM-D909" is used interchangeably with both "supercharge rating" and "performance number."

C. Determination of Knock Cycles and Intensity Rating

For purposes of this application, "Knock Cycle/Intensity rating test" and "Lycoming IO-360 tests" are used interchangeably. The Knock CyclesIntensity rating test was performed with a Textron Lycoming IO-360 engine ("the Lycoming engine") on a dynamometer test stand (See FIG. 1). Each of the four cylinders of the Lycoming engine was equipped with a Kistler 6061B piezoelectric transducer. These transducers produce electric charges proportional to the detected pressures in the combustion chambers in the Lycoming Engine. The charge was then passed into four Kistler 5010 charge mode amplifiers which were calibrated so that output voltage from the amplifiers was equivalent to 20 atmospheres as read by the detector. The voltage was processed through a National Instruments NB-A2000 A/D board which reads all four channels simultaneously at a rate of 250,000 samples per second at a resolution of 12 bits.

Figure 2:
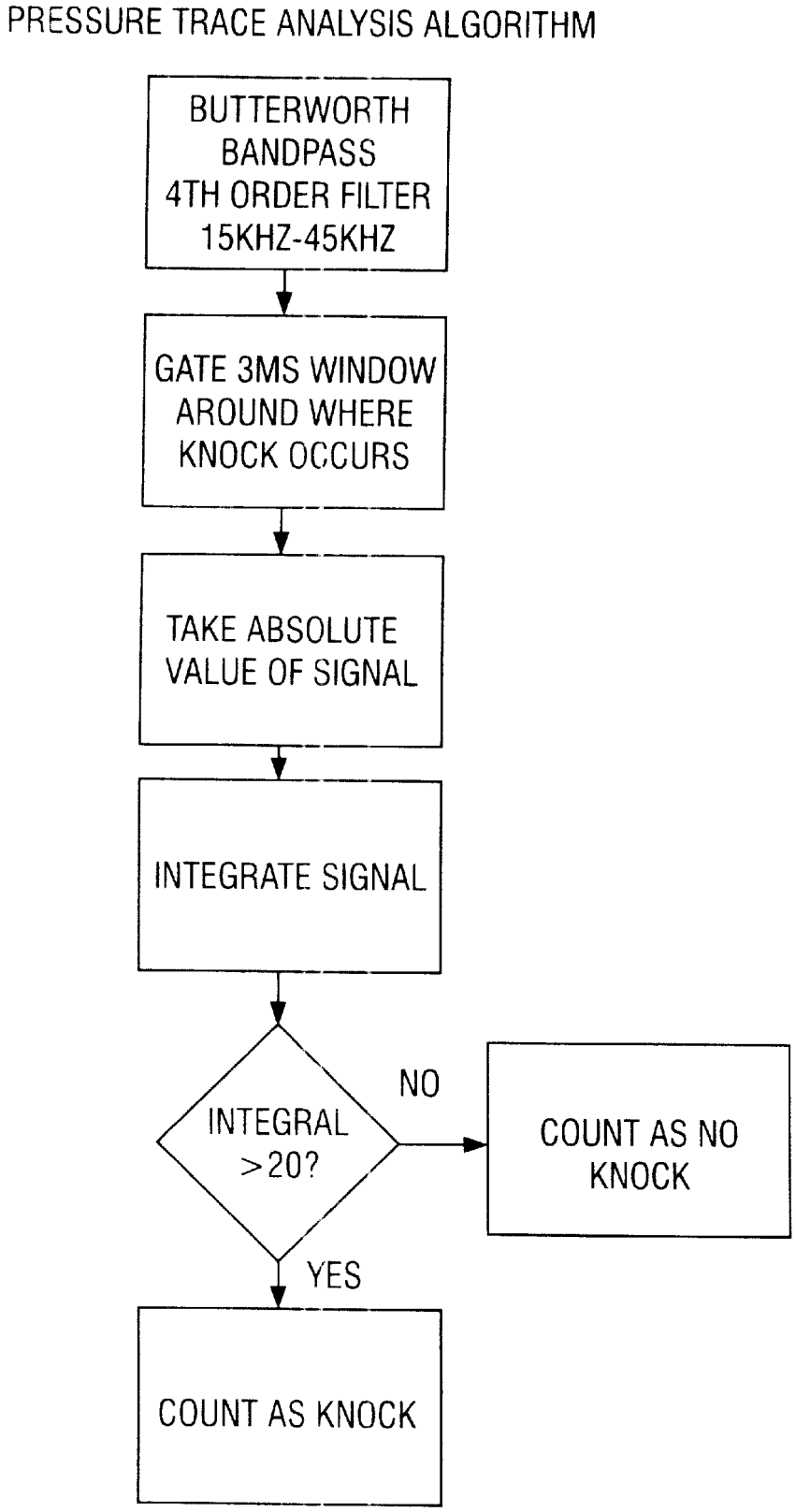
FIG. 2 is an algorithm of the data acquisition program for determining Knock Cycles and Intesity Ratings as described in the Examples, Section C.

The data acquisition was facilitated by a computer program (See FIG. 2) using National Instruments' Labview programming environment. The data acquisition program stores the data from 200 to 400 consecutive firings from the engine which is typically operated at 2700 rpm, wide open throttle at an equivalence ratio of about 1.12 and maximum cylinder temperature of just below 500° F. The data is first stored into buffers, then into the Random Access Memory of a MacIntosh 8100/80 Power PC and finally on the hard drive. The raw data files were then backed up onto magneto-optical discs and post-processed using a Labview program.

Before storage and processing, data from the individual combustion chamber firings were passed through a Butterworth 4th order digital bandpass filter of 15 kHz–45 kHz range. This is done to isolate frequencies which could only be significantly excited within the combustion chamber by a knocking event. The filtered signal was then "windowed" for 3 milliseconds near top dead center of piston travel (compression/expansion stroke). The filtered, windowed signal was then sent through an absolute-value function and integrated to obtain a pressure-time-intensity expression of the acoustic energy supplied to the filter in the 15 kHz–45 kHz band of frequencies detected by the system. This value was used to create a scale with which knock intensity was measured. If the intensity of the integral was found to be greater than 20 on this scale, it was determined to be a knocking case and the knocking events per 200 cycles were recorded.

Figure 3:
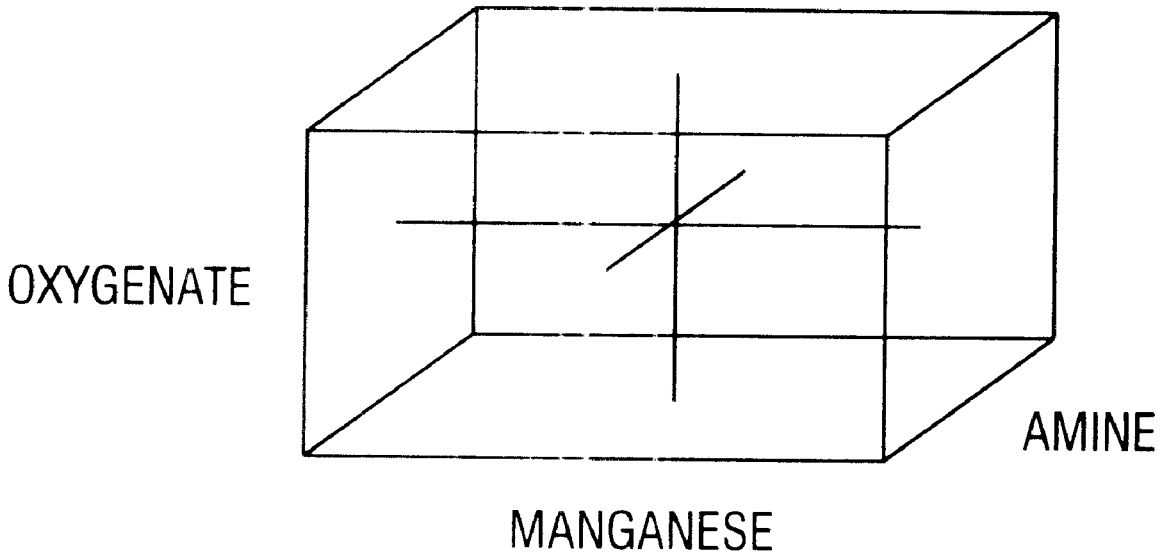
FIG. 3 is a face-centered cube statistical design model for investigating the relationships among the in-cylinder oxidation chemistries of the octane boosting additives and the basefuel as described in the Examples, Section D.
Figure 4:
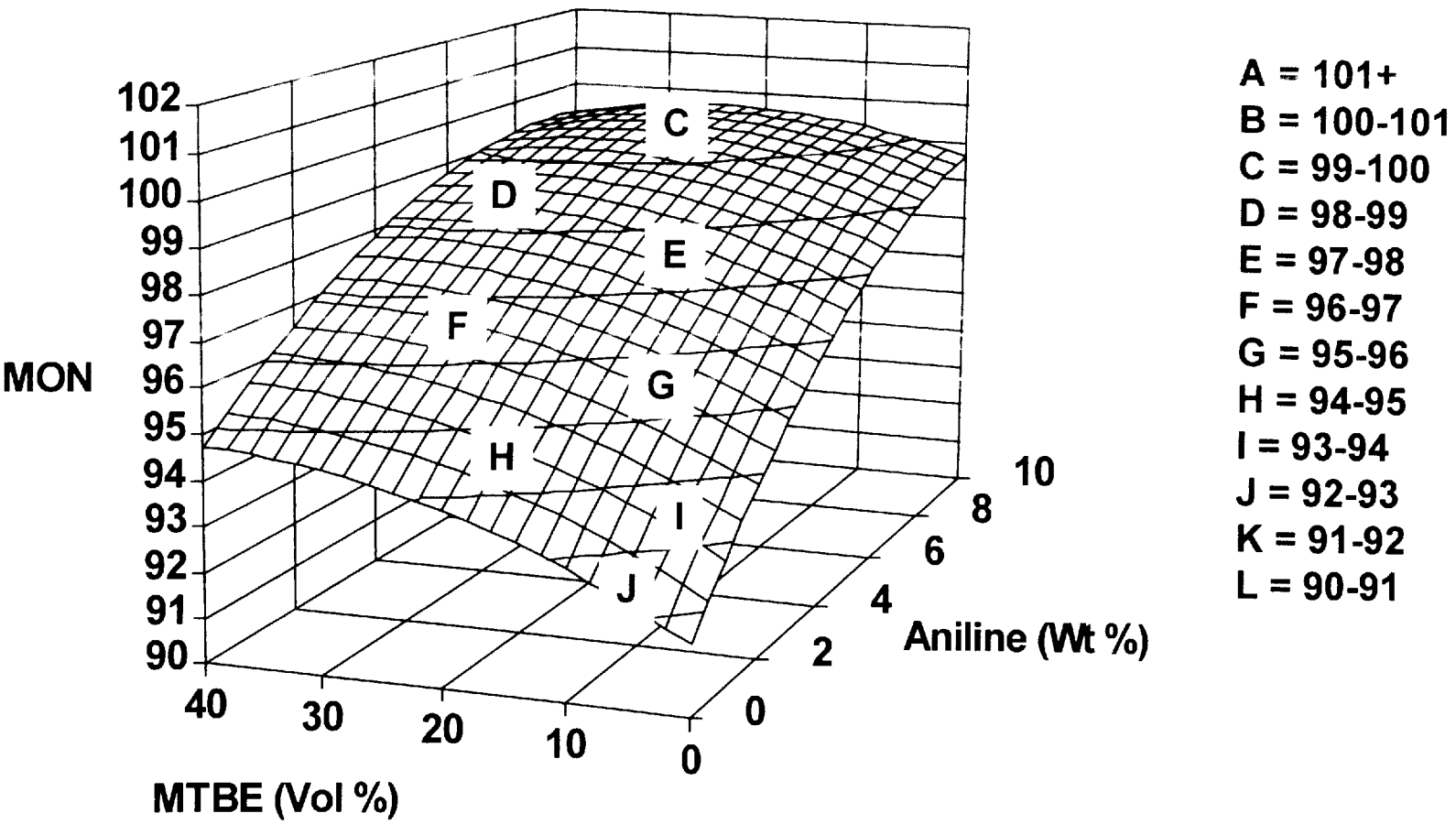
FIG. 4 is a model representing predicted MON values as a function of concentration of MTBE and aniline with 0 g/gal manganese. This model is based on data from experiments as described in the Examples, Section D.
Figure 5:
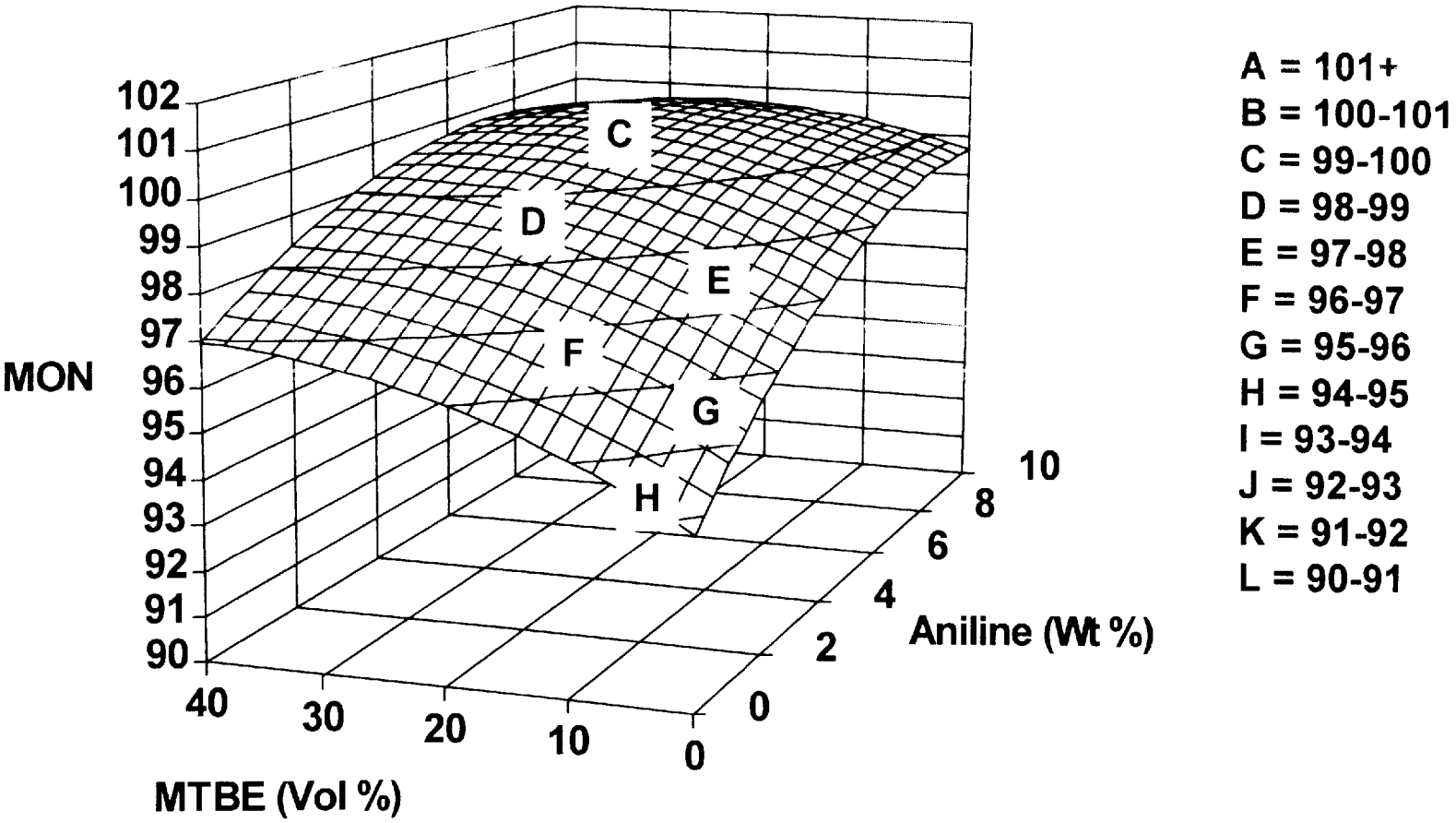
FIG. 5 is a model representing predicted MON values as a function of concentration of MTBE and aniline with 0.25 g/gal manganese. This model is based on data from experiments as described in the Examples, Section D.
Figure 6:
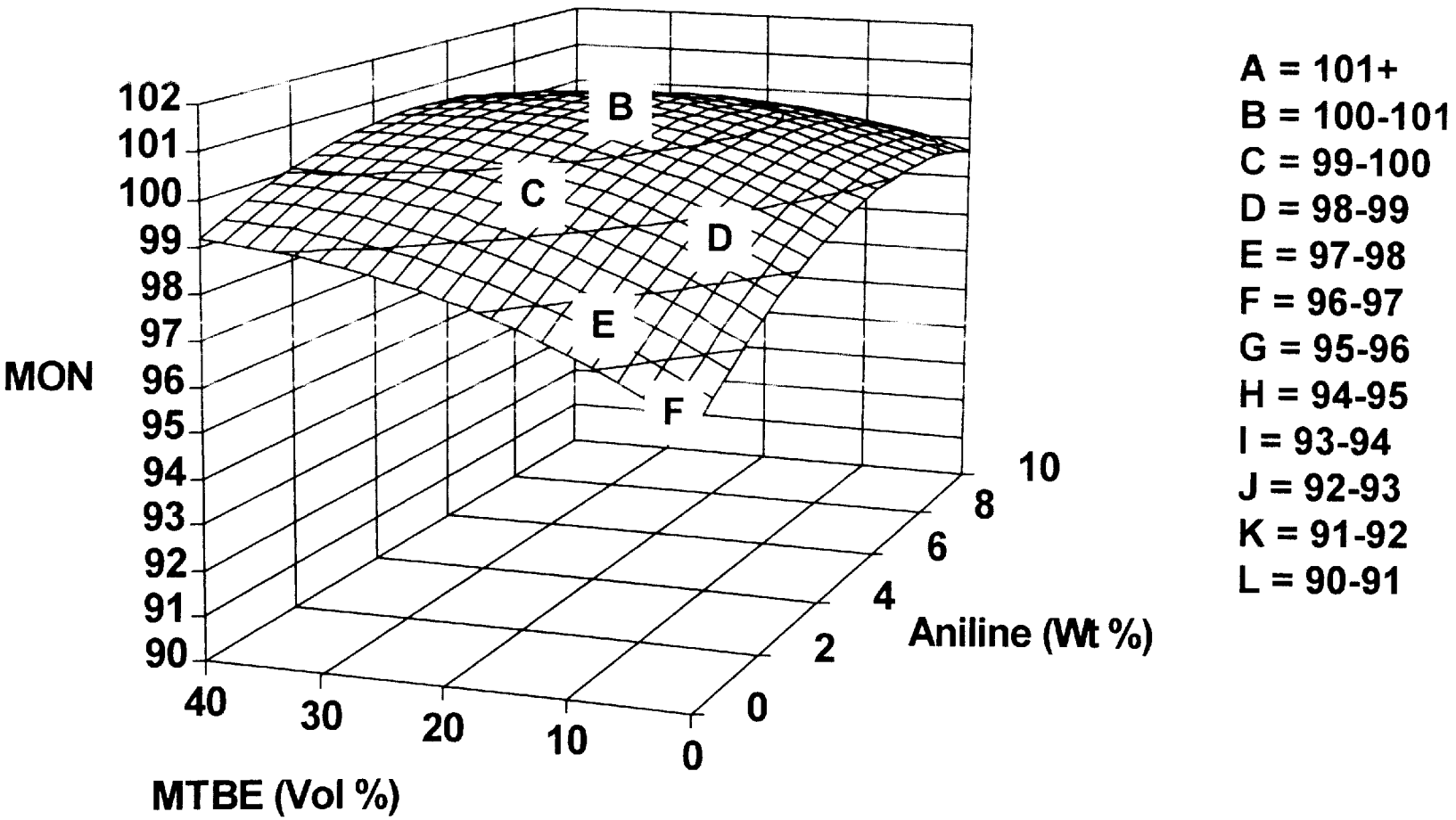
FIG. 6 is a model representing predicted MON values as a function of concentration of MTBE and aniline at 0.50 g/gal manganese. This model is based on data from experiments as described in the Examples, Section D.
Figure 7:
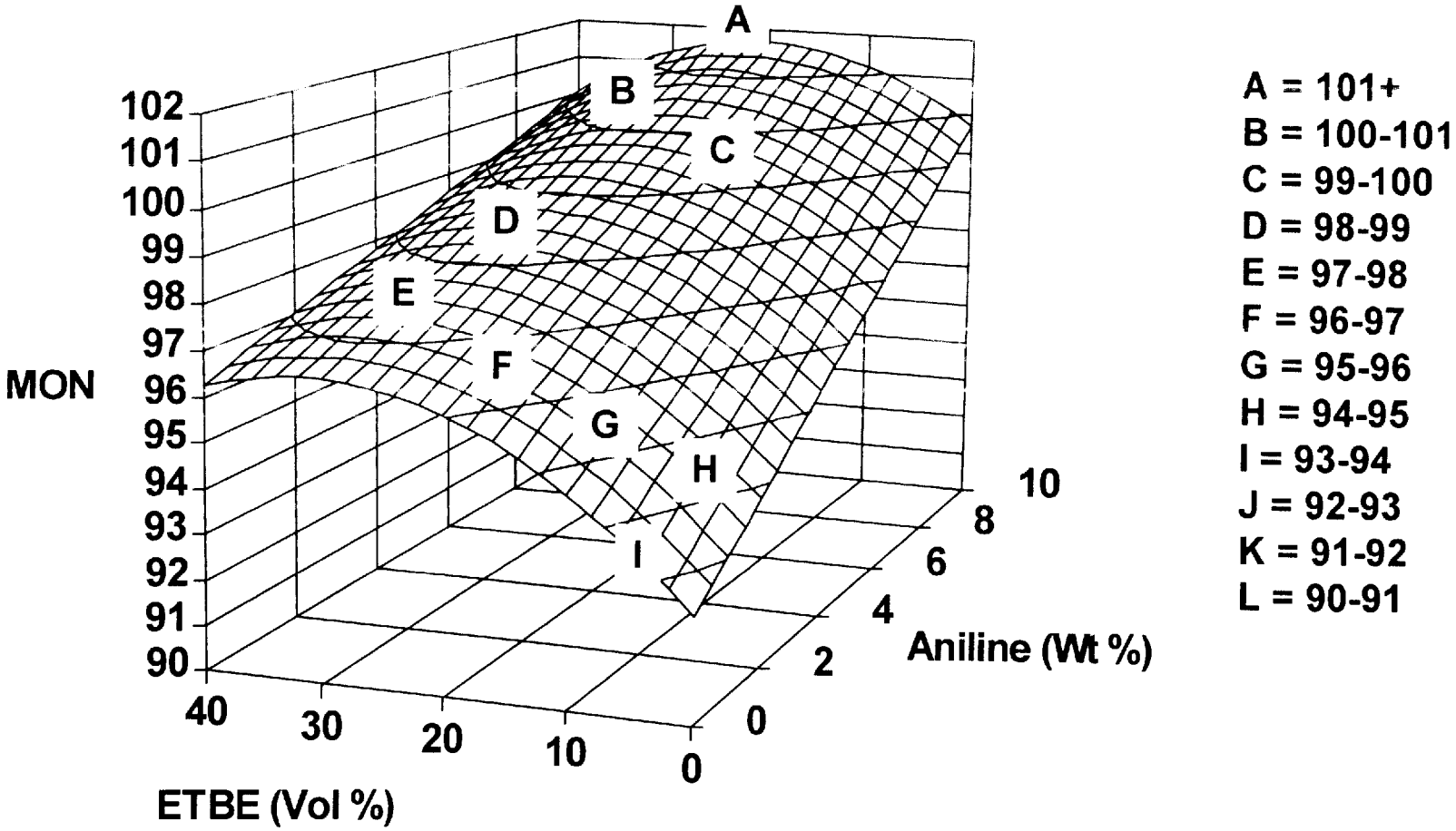
FIG. 7 is a model representing predicted MON values as a function of concentration of ETBE and aniline at 0 g/gal manganese. This model is based on data from experiments as described in the Examples, Section D.
Figure 8:
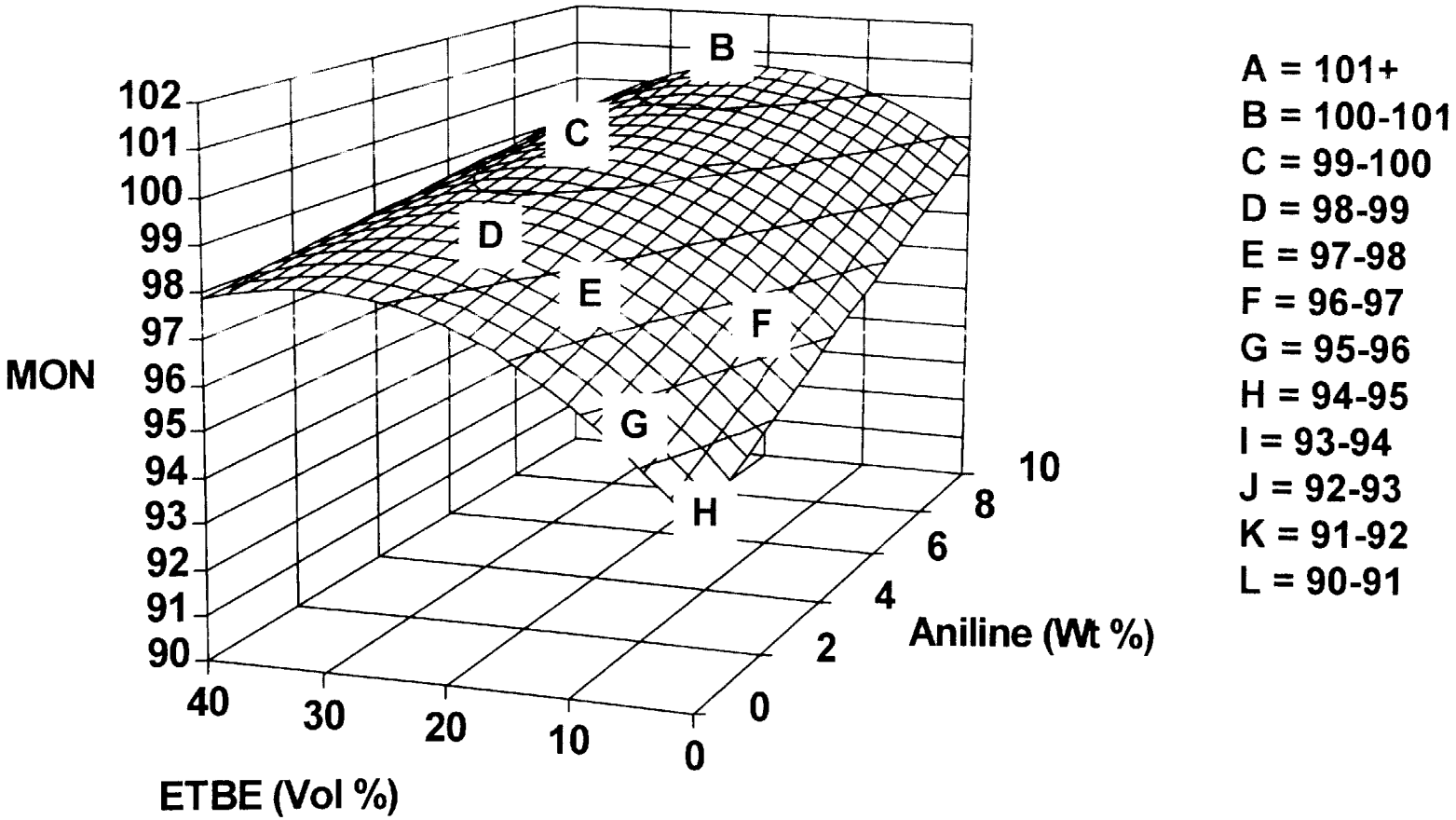
FIG. 8 is a model representing predicted MON values as a function of concentration of ETBE and aniline at 0.25 g/gal manganese. This model is based on data from experiments as described in the Examples, Section D.
Figure 9:
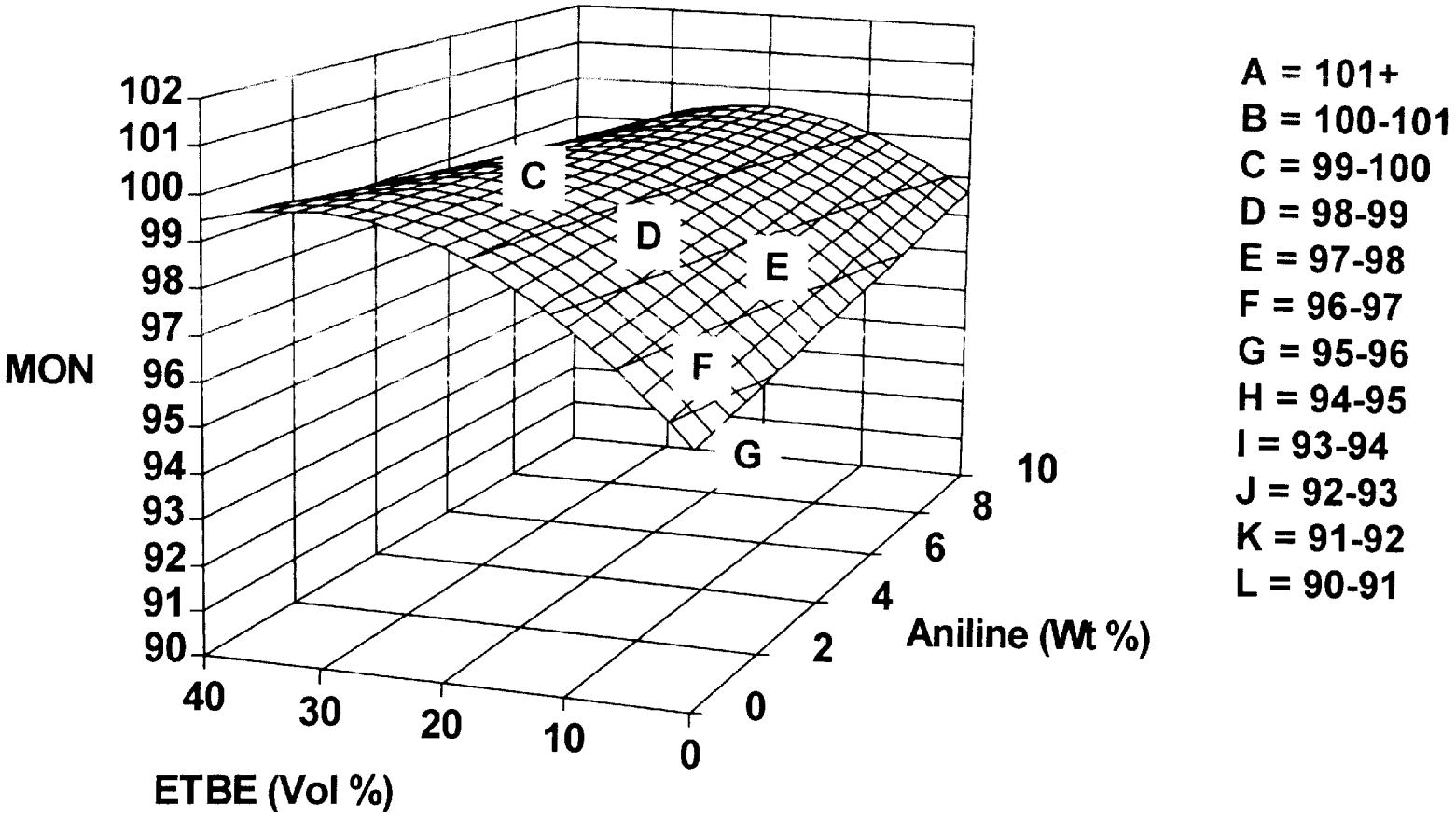
FIG. 9 is a model representing predicted MON values as a function of concentration of ETBE and aniline at 0.50 g/gal manganese. This model is based on data from experiments as described in the Examples, Section D.
Figure 10:
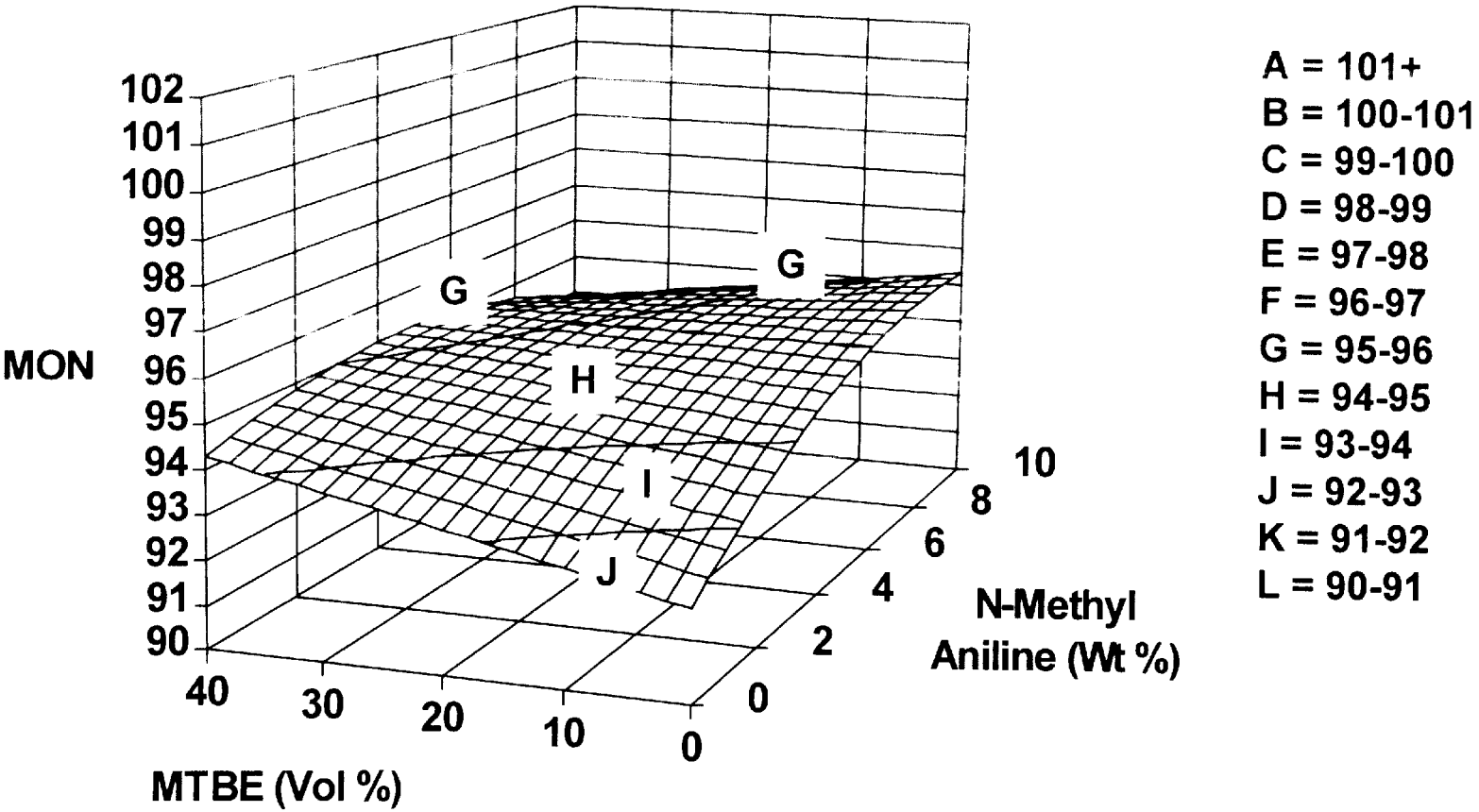
FIG. 10 is a model representing predicted MON values as a function of concentration of MTBE and N-methyl-aniline at 0 g/gal manganese. This model is based on data from experiments as described in the Examples, Section D.
Figure 11:
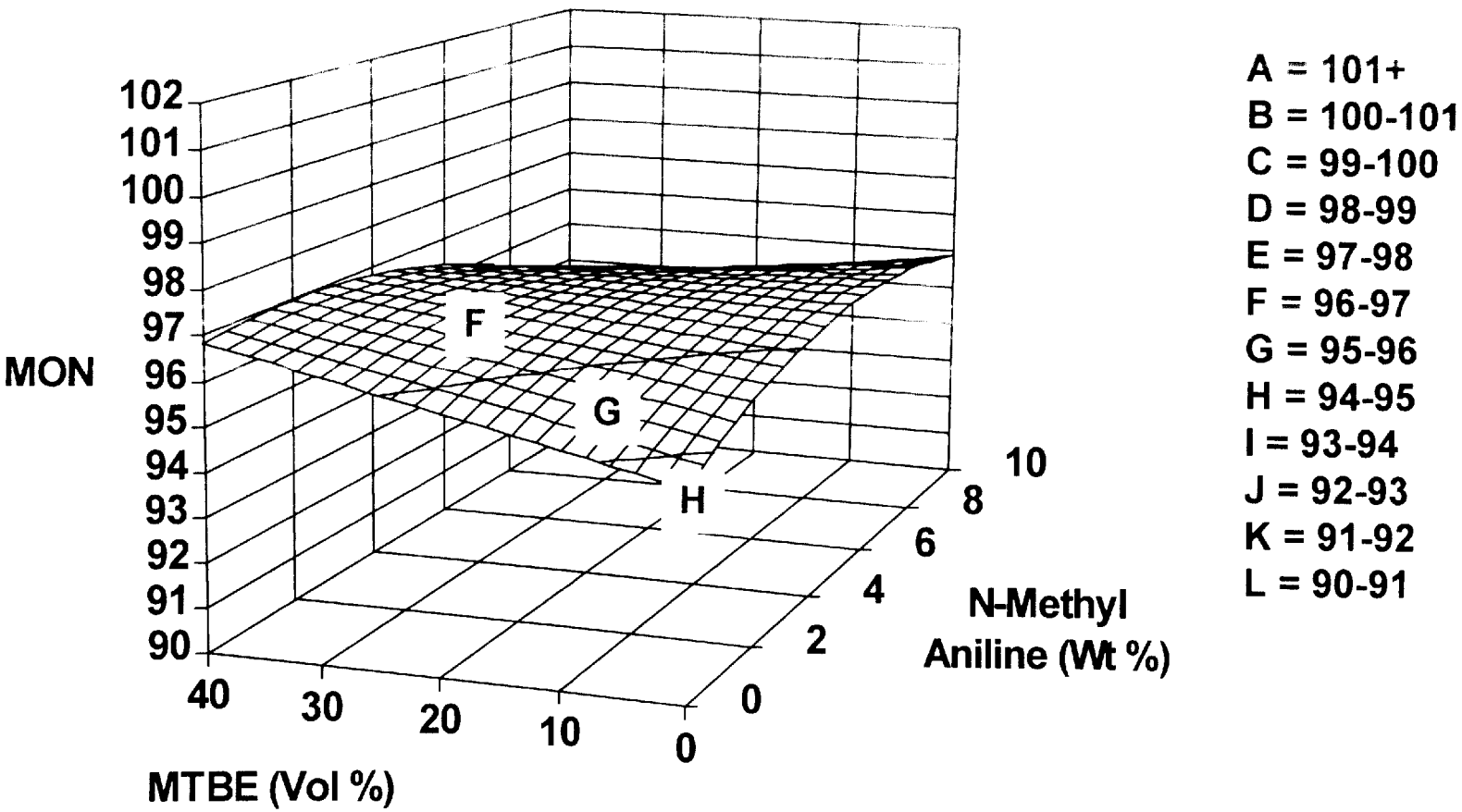
FIG. 11 is a model representing predicted MON values as a function of concentration of MTBE and N-methyl-aniline at 0.25 g/gal manganese. This model is based on data from experiments as described in the Examples, Section D.
Figure 12:
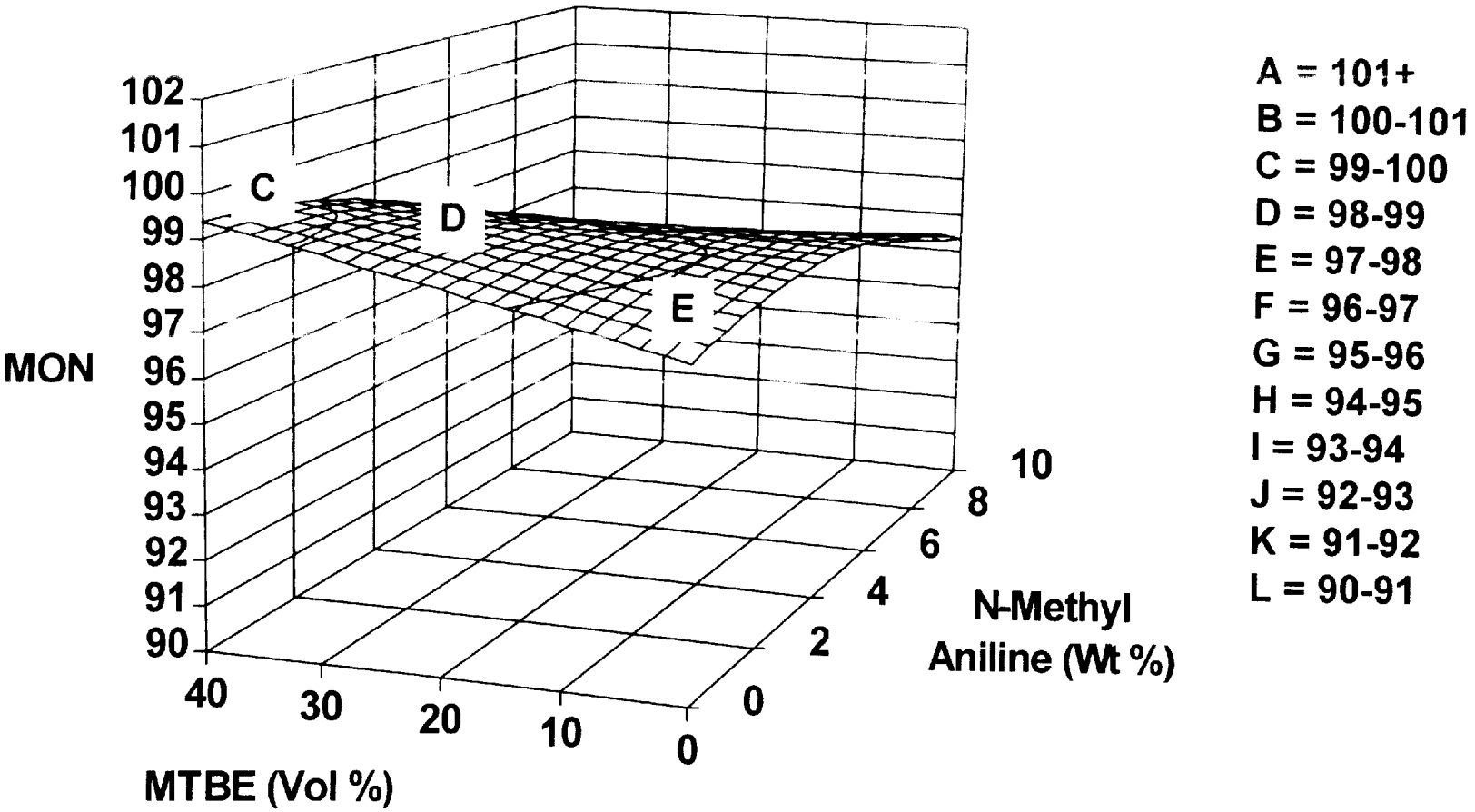
FIG. 12 is a model representing predicted MON values as a function of concentration of MTBE and N-methyl-aniline at 0.50 g/gal manganese. This model is based on data from experiments as described in the Examples, Section D.
Figure 13:
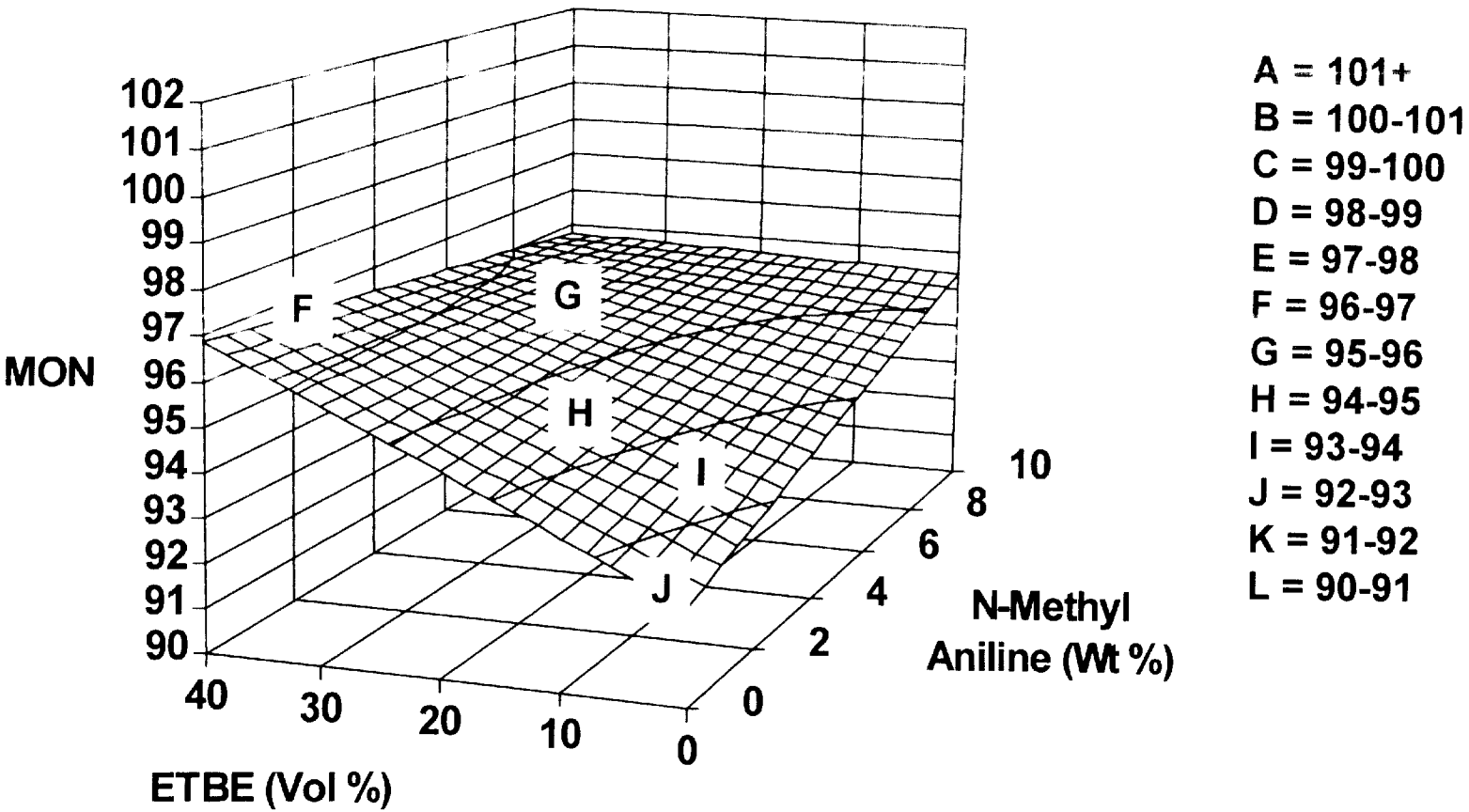
FIG. 13 is a model representing predicted MON vaques as a function of concentration of ETBE and N-methyl-aniline at 0 g/gal manganese. This model is based on data from experiments as described in the Examples, Section D.
Figure 14:
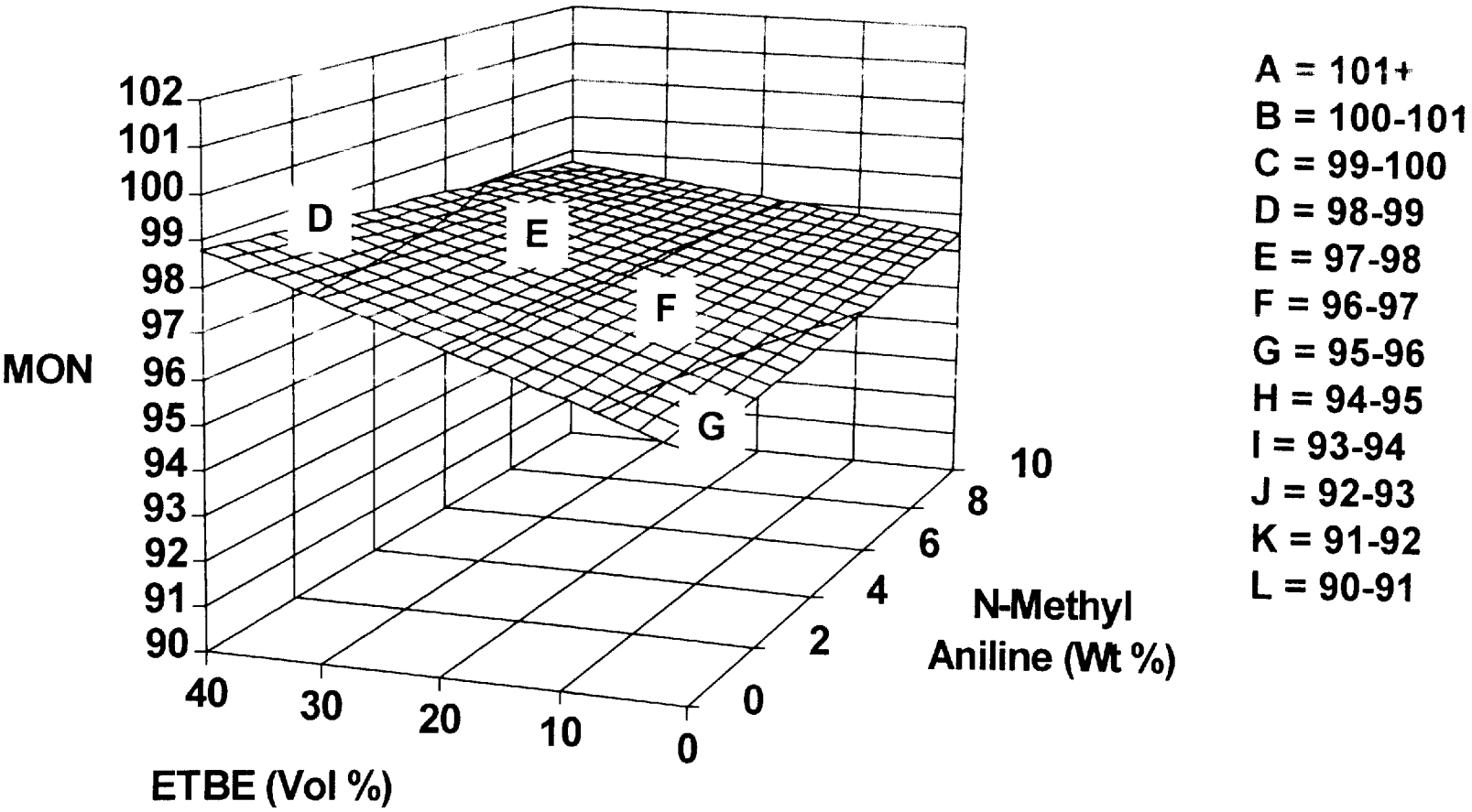
FIG. 14 is a model representing predicted MON values as a function of concentration of ETBE and N-methyl-aniline at 0.25 g/gal manganese. This model is based on data from experiments as described in the Examples, Section D.
Figure 15:
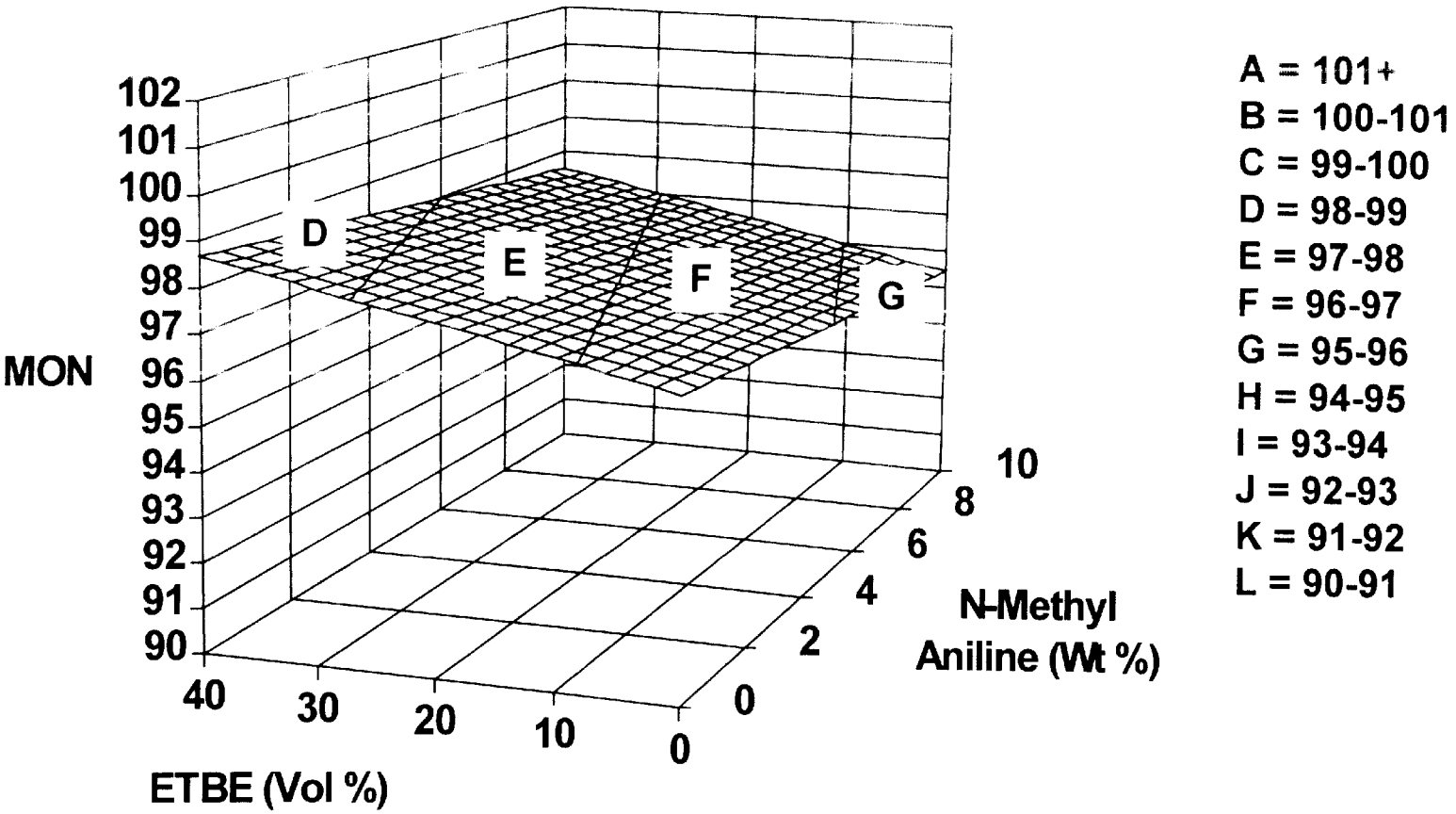
FIG. 15 is a model representing predicted MON values as at function of concentration of ETBE and N-methyl-aniline at 0.50 g/gal manganese. This model is based on data from experiments as described in the Examples, Section D.
Figure 16:
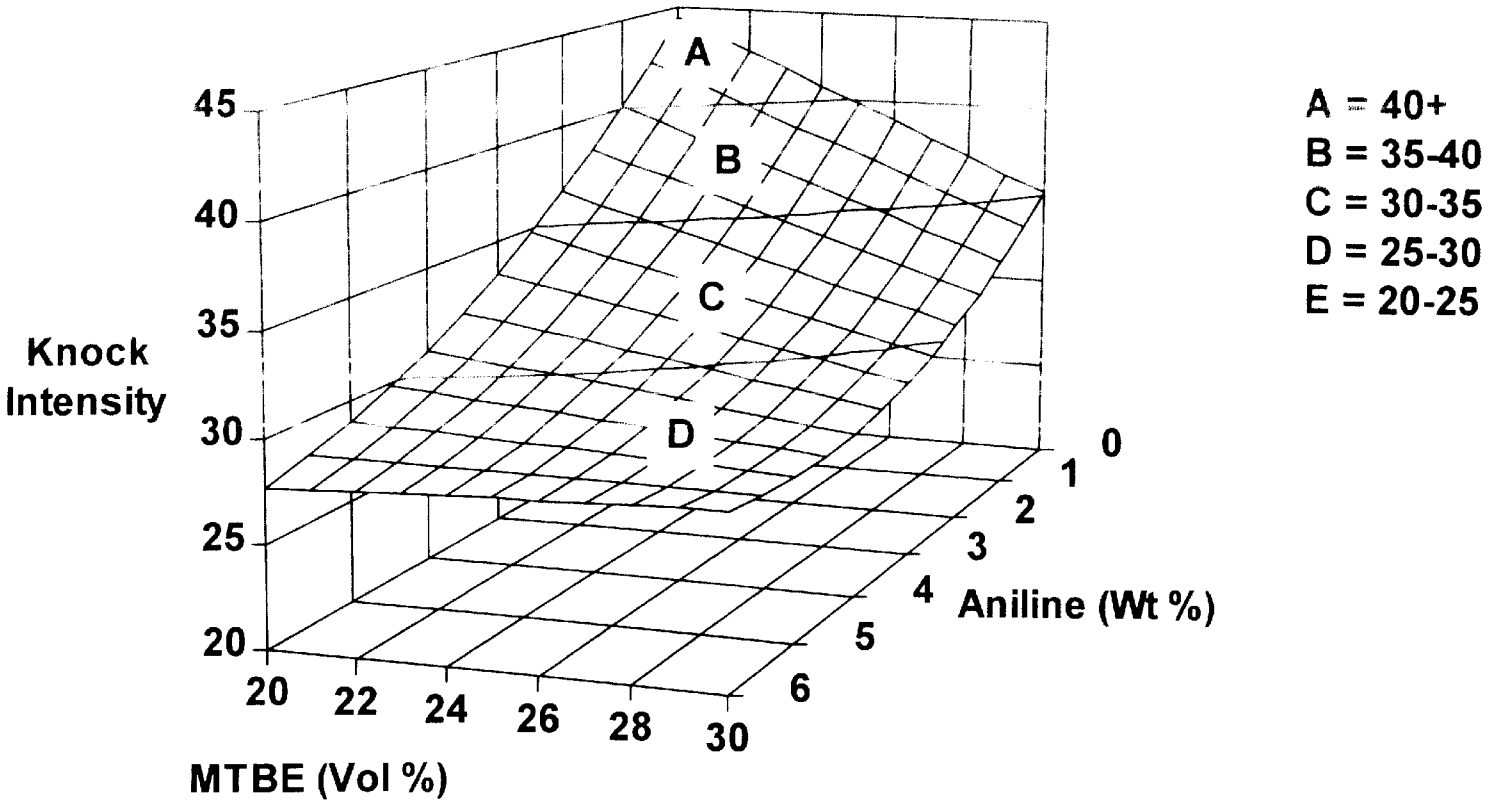
FIG. 16 is a model representing predicted average knock intensity values as a function of concentration of MTBE and aniline at 0 g/gal manganese. This model is based on data from experiments as described in the Examples, Section E.
Figure 17:
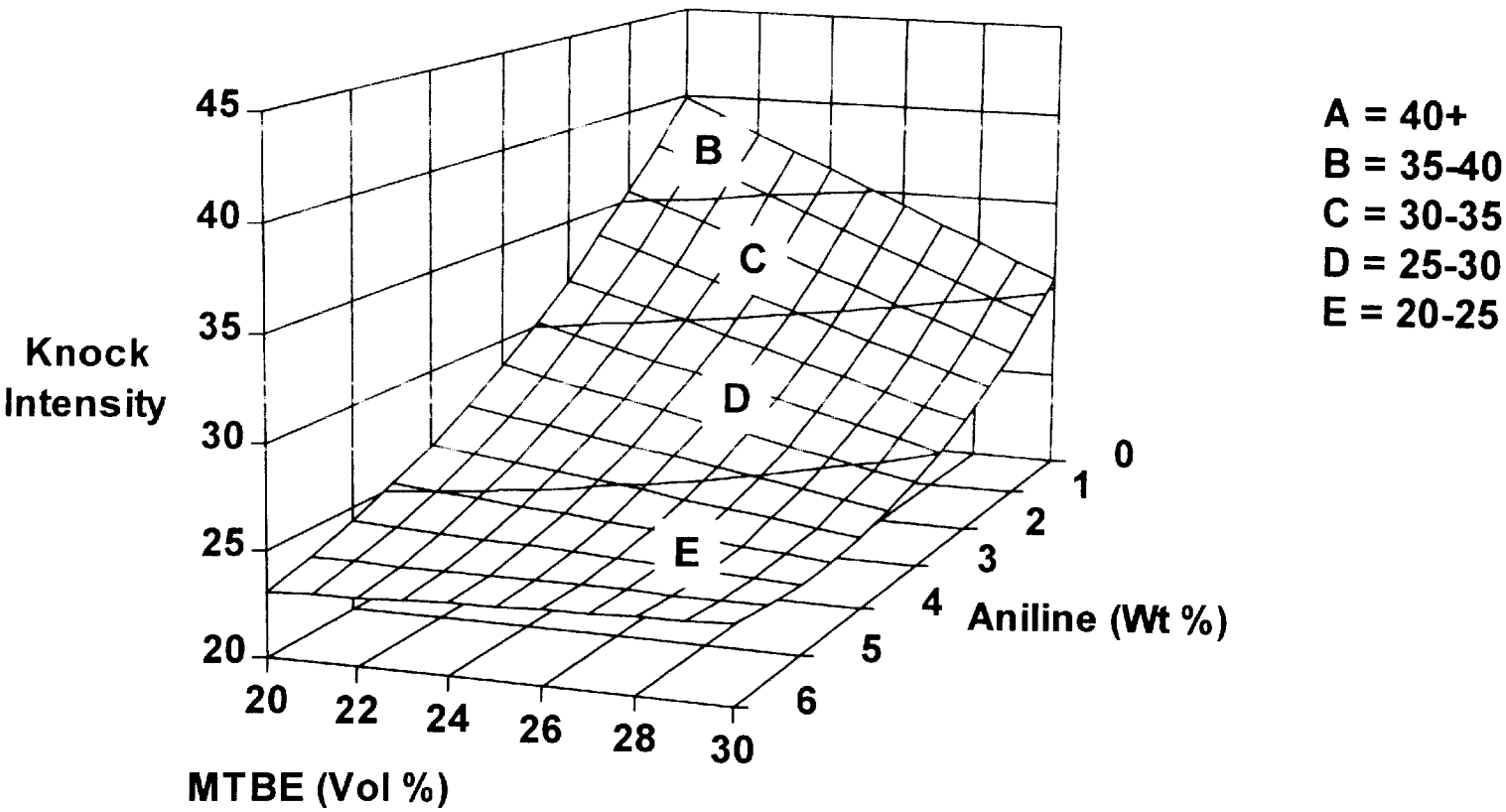
FIG. 17 is a model representing predicted average knock intensity values as a function of concentration of MTBE and aniline at 0.05 g/gal manganese. This model is based on data from experiments as described in the Examples, Section E.
Figure 18:
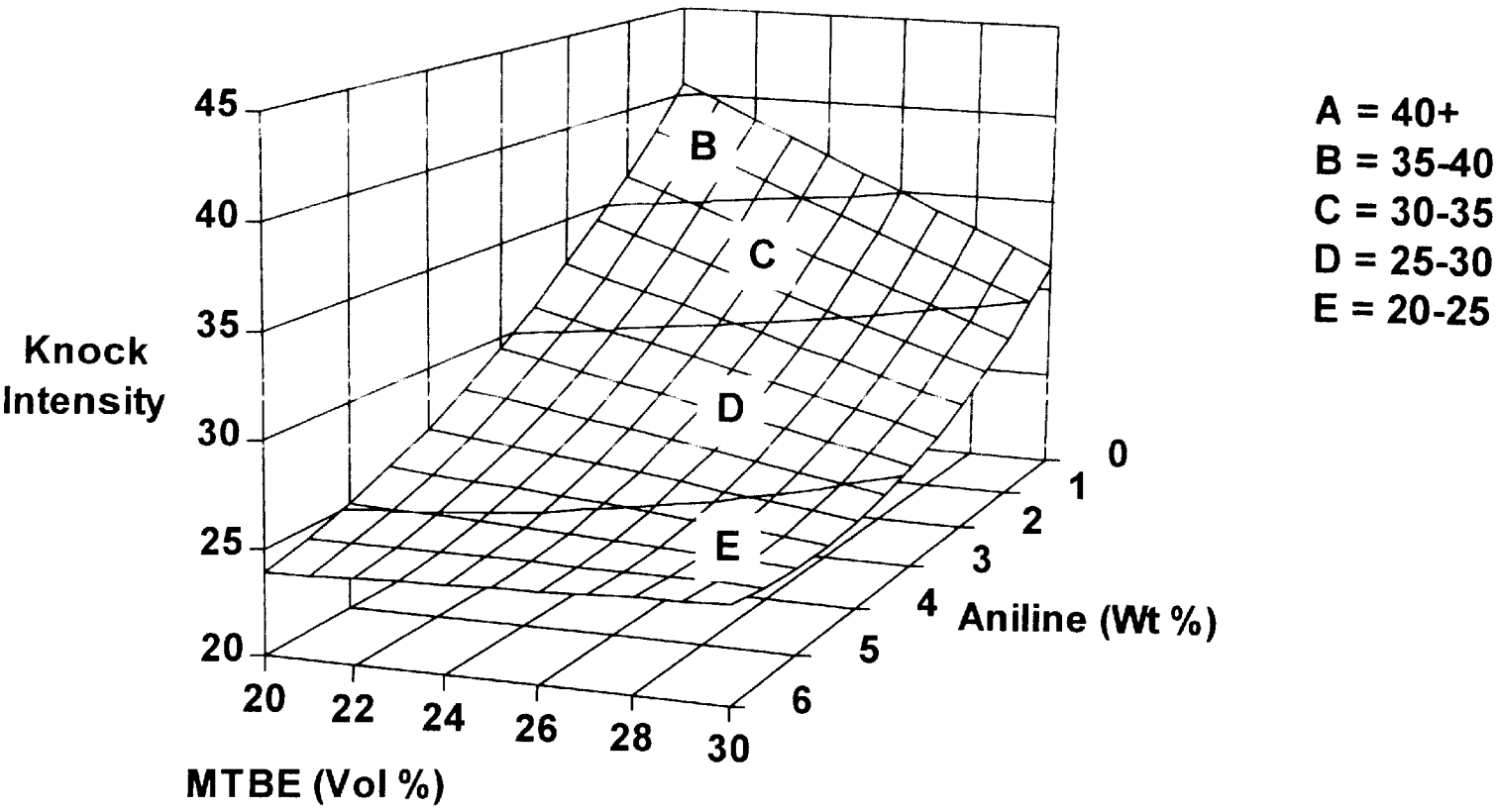
FIG. 18 is a model representing predicted average knock intensity values as a function of concentration of MTBE and aniline at 0.10 g/gal manganese. This model is based on data from experiments as described in the Examples, Section E.
Figure 19:
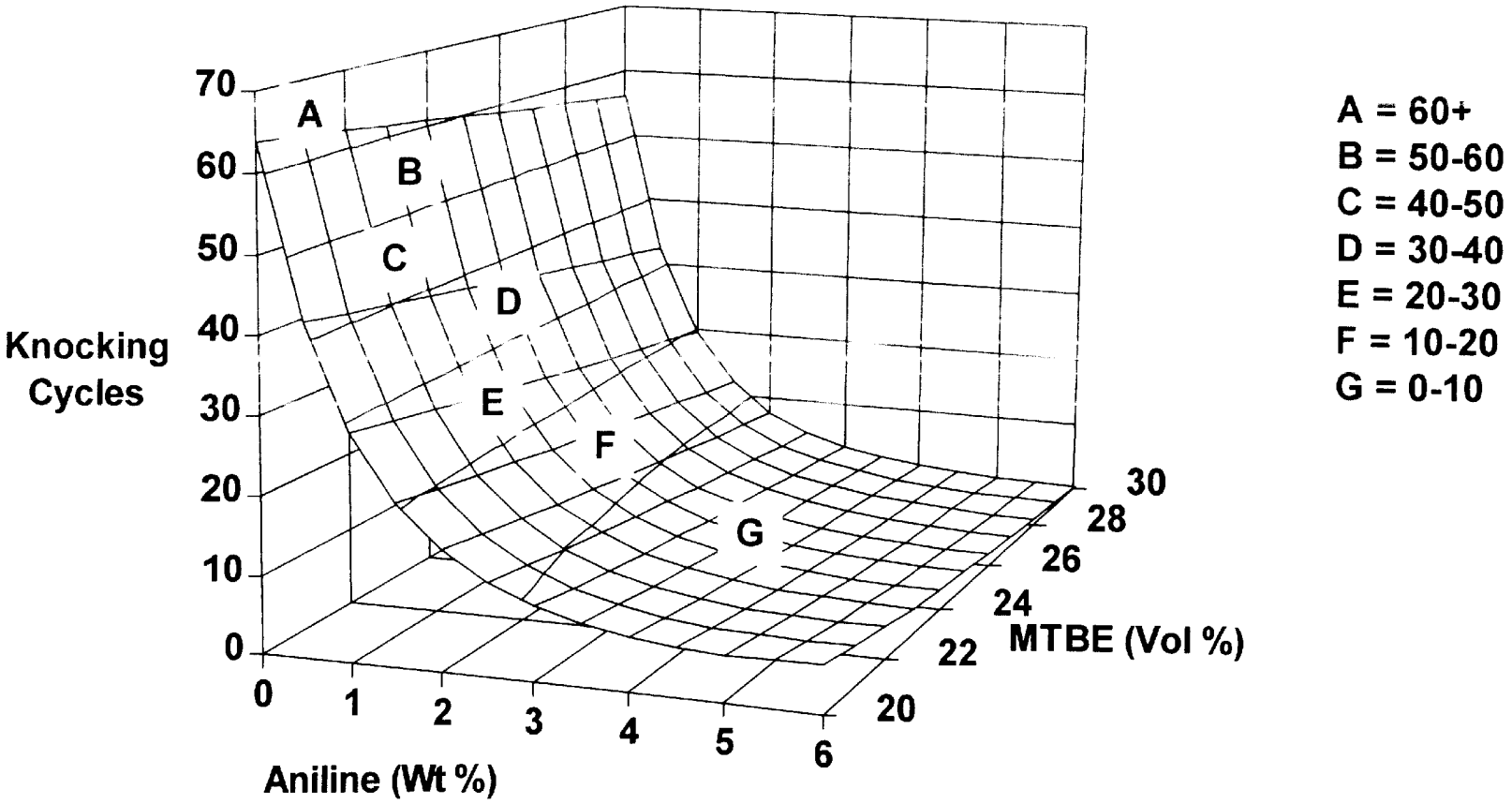
FIG. 19 is a model representing predicted average number of knocking cycles as a function of concentration of MTBE and aniline at 0 g/gal manganese. This model is based on data from experiments as described in the Examples, Section E.
Figure 20:
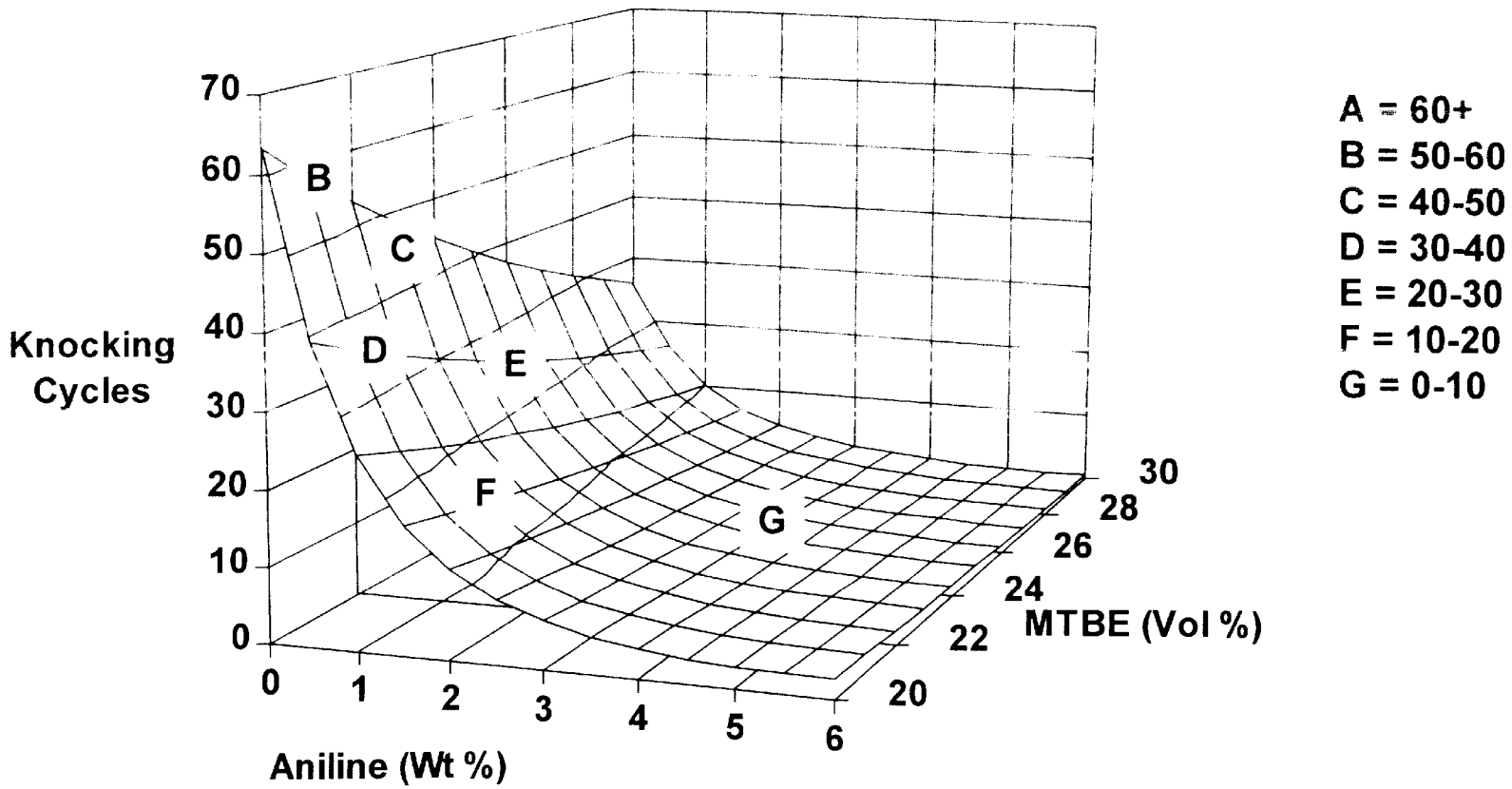
FIG. 20 is a model representing predicted average number of knocking cycles as a function of concentration of MTBE and aniline at 0.05 g/gal manganese. This model is based on data from experiments as described in the Examples, Section E.
Figure 21:
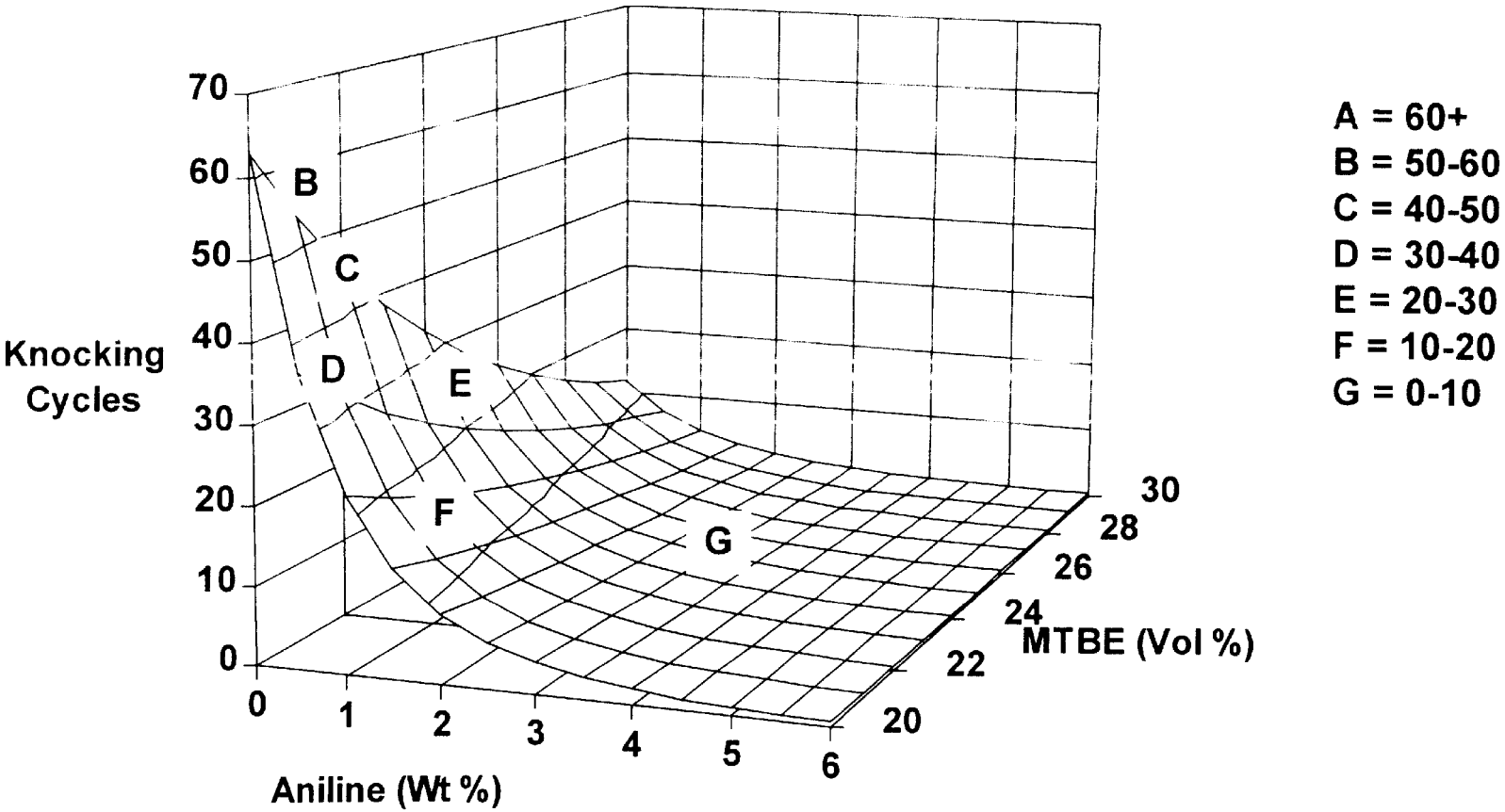
FIG. 21 is a model representing predicted average number of knocking cycles as a function of concentration of MTBE and aniline at 0.10 g/gal manganese. This model is based on data from experiments as described in the Examples, Section E.
Figure 22:
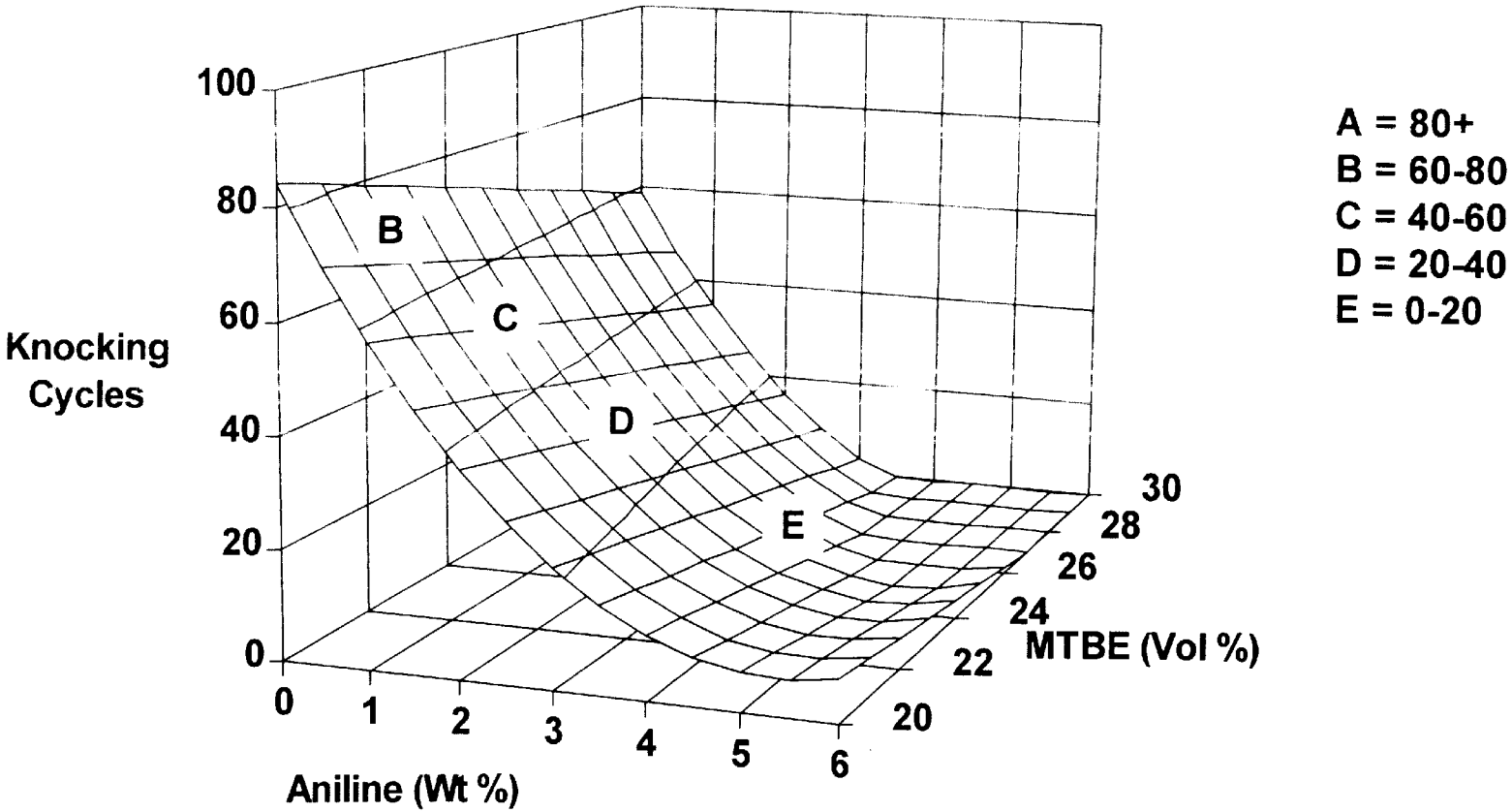
FIG. 22 is a model representing predicted average number of knocking cycles as a function of concentration of MTBE and aniline at 0 g/gal manganese. This model is based on data from experiments as described in the Examples, Section E.
Figure 23:
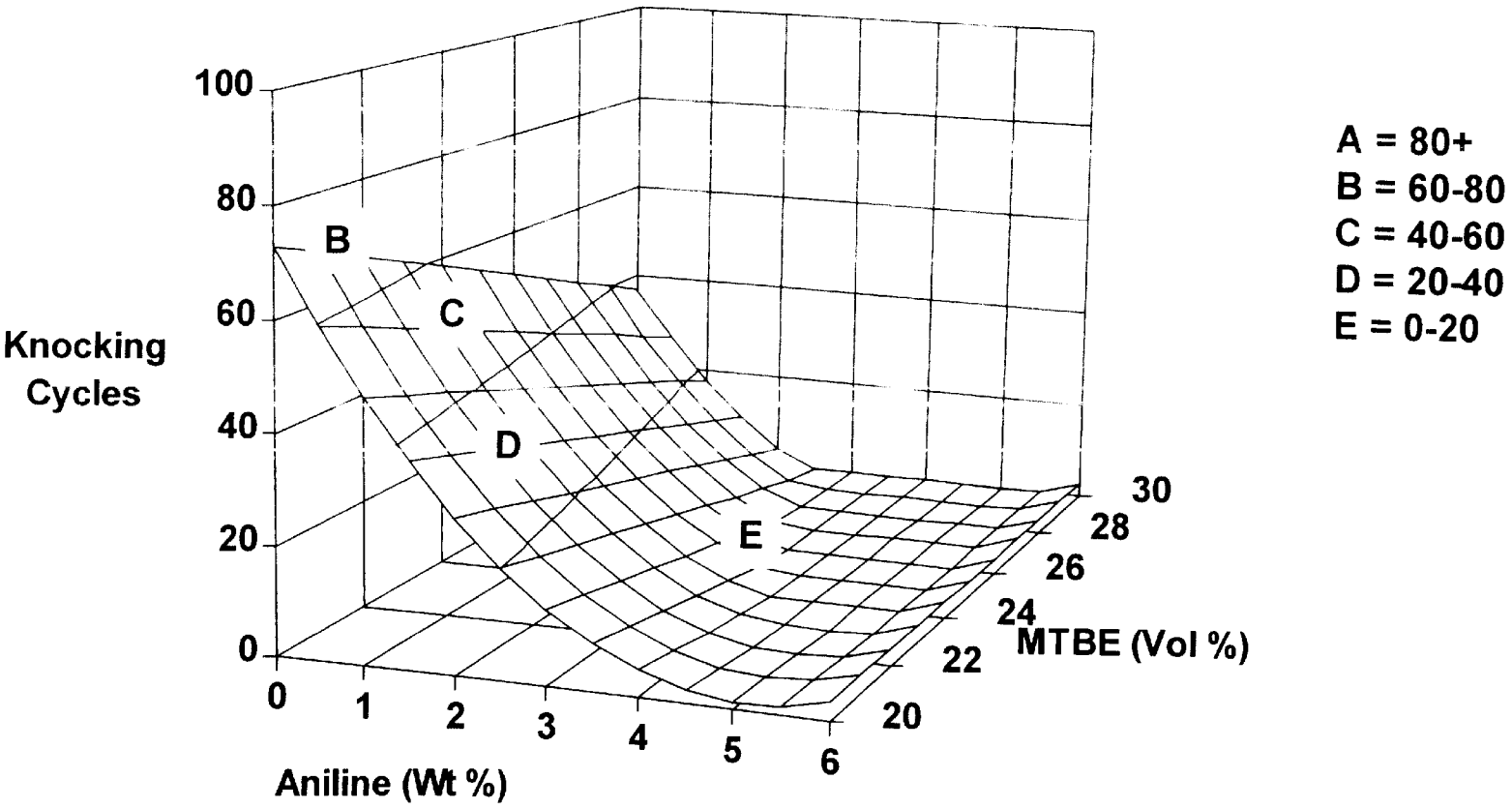
FIG. 23 is a model representing predicted average number of knocking cycles as a function of concentration of MTBE and aniline at 0.05 g/gal manganese. This model is based on data from experiments as described in the Examples, Section E.
Figure 24:
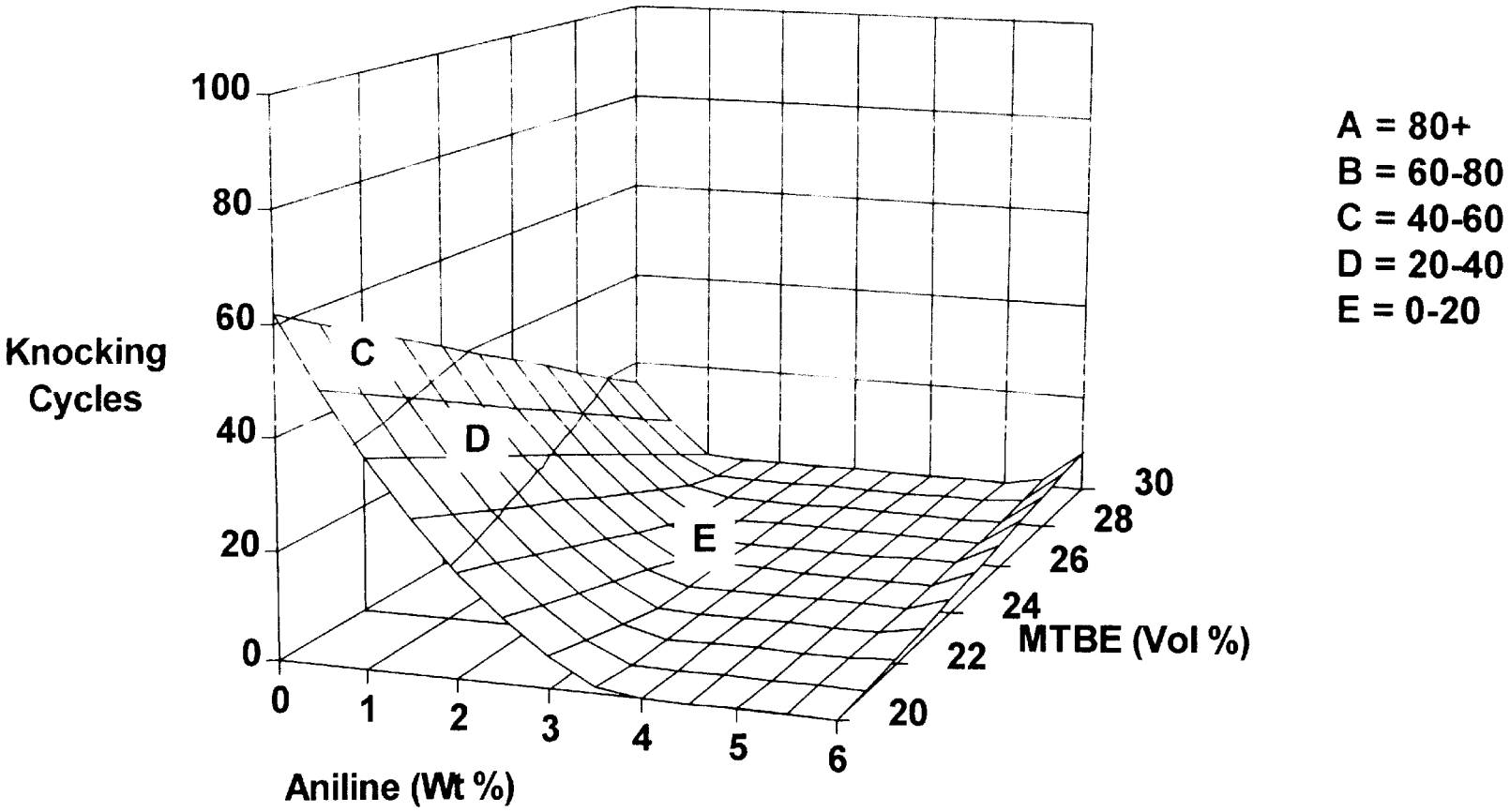
FIG. 24 is a model representing predicted average number of knocking cycles as a function of concentration of MTBE and aniline at 0.10 g/gal manganese. This model is based on data from experiments as described in the Examples, Section E.
Figure 25:
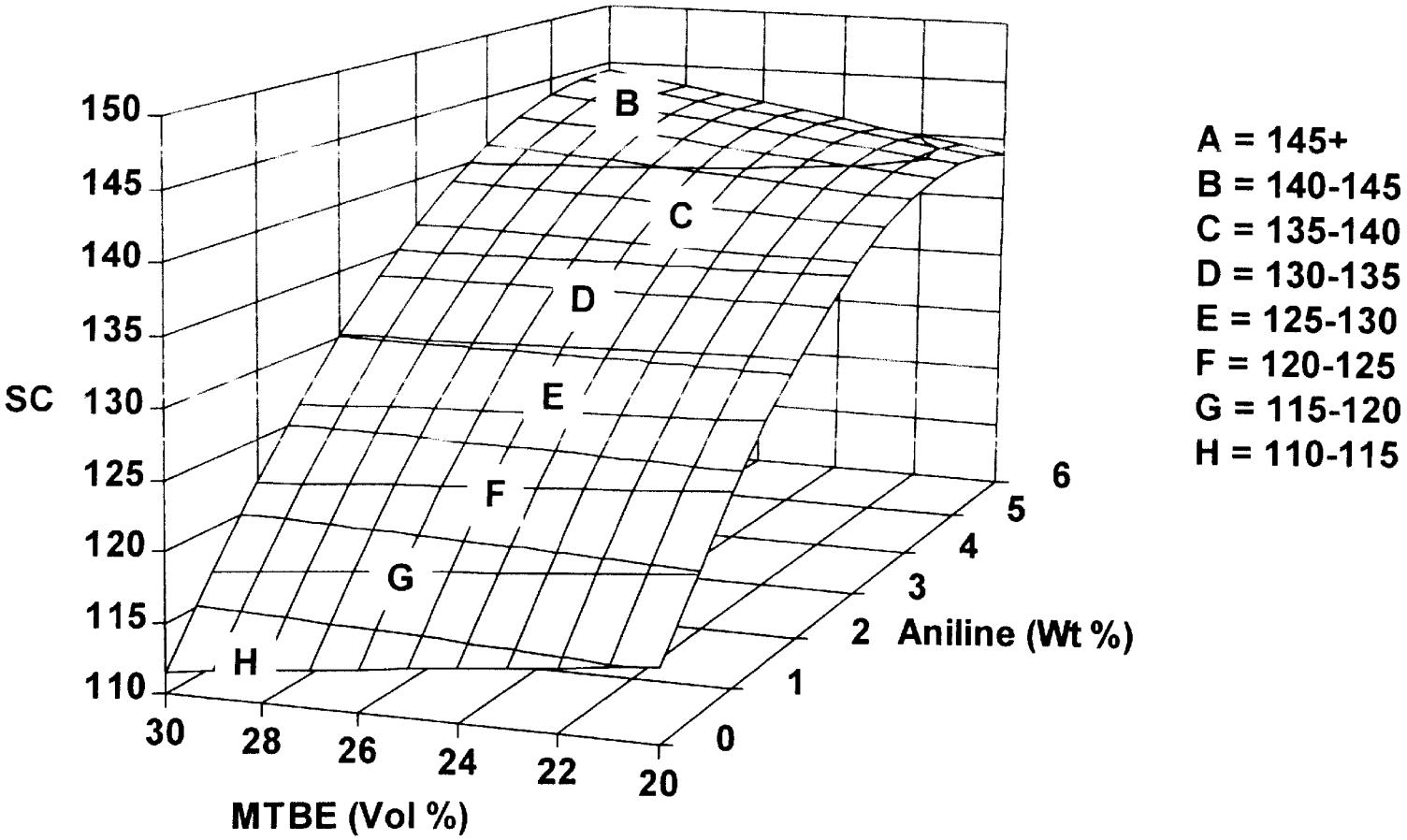
FIG. 25 is a model representing predicted Supercharge as a function of concentration of MTBE and aniline at 0 g/gal manganese. This model is based on data from experiments as described in the Examples, Section E.
Figure 26:
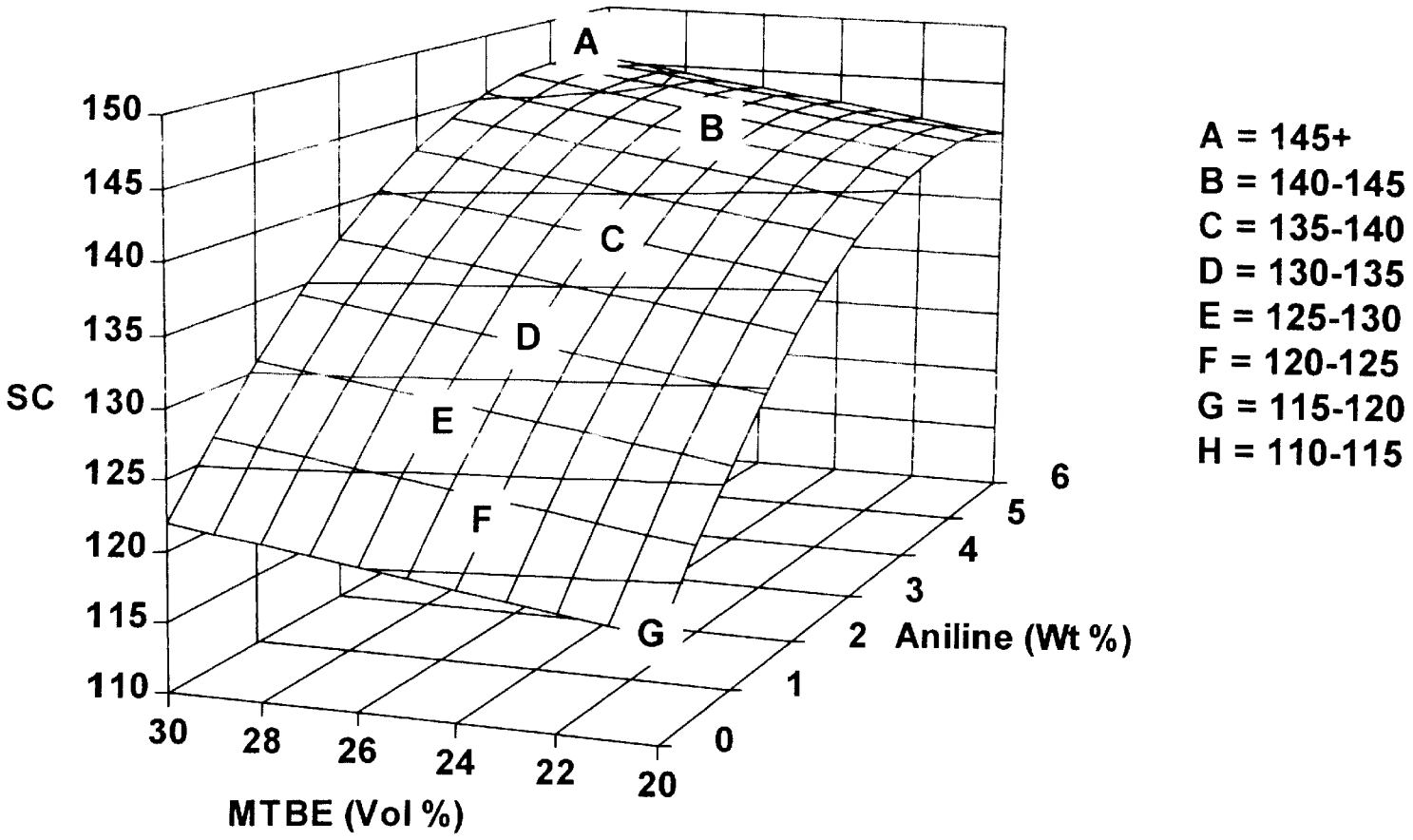
FIG. 26 is a model representing predicted Supercharge as a function of concentration of MTBE and aniline at 0.05 g/gal manganese. This model is based on data from experiments as described in the Examples, Section E.
Figure 27:
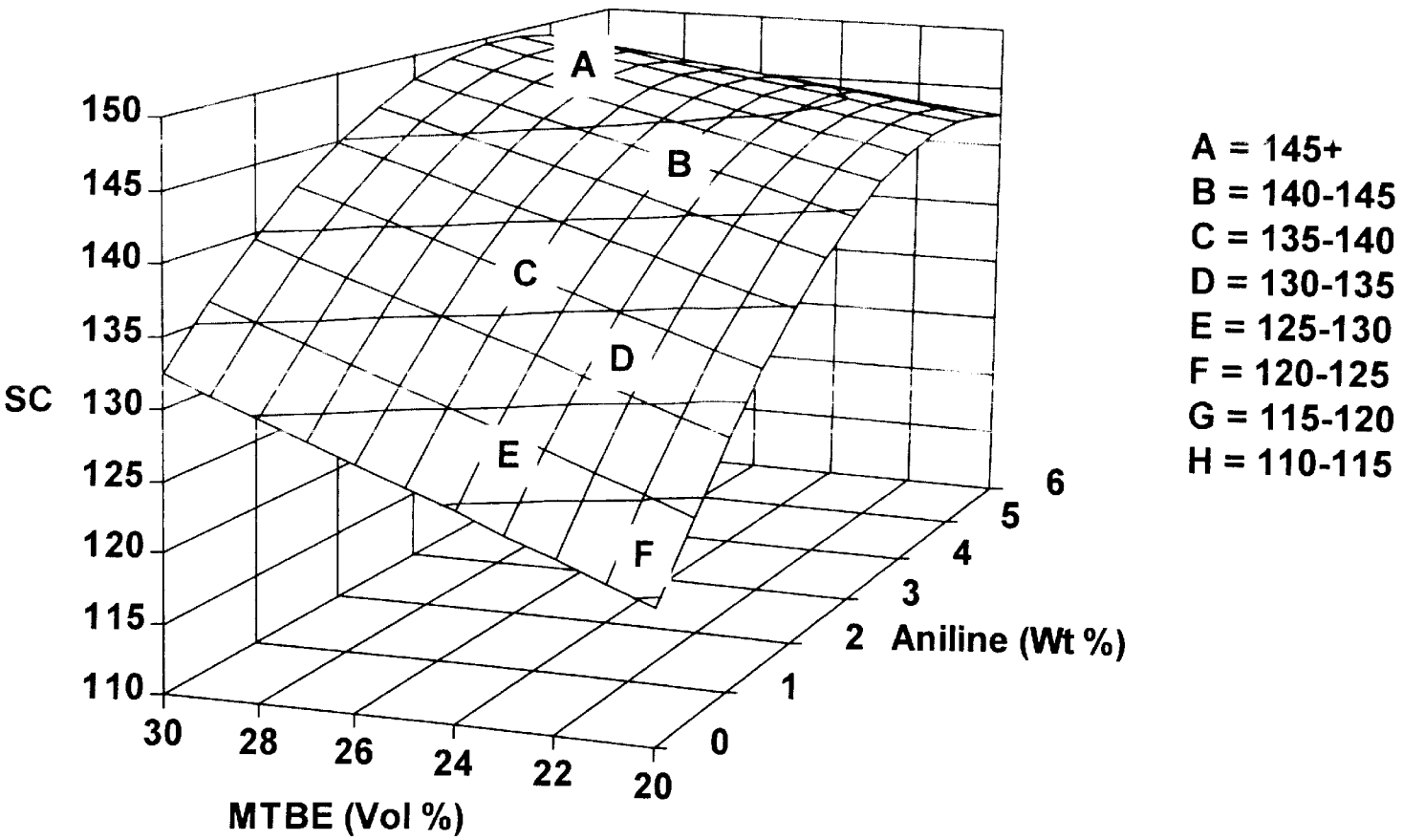
FIG. 27 is a model representing predicted Supercharge as a function of concentration of MTBE and aniline at 0.10 g/gal manganese. This model is based on data from experiments as described in the Examples, Section E.
Figure 28:
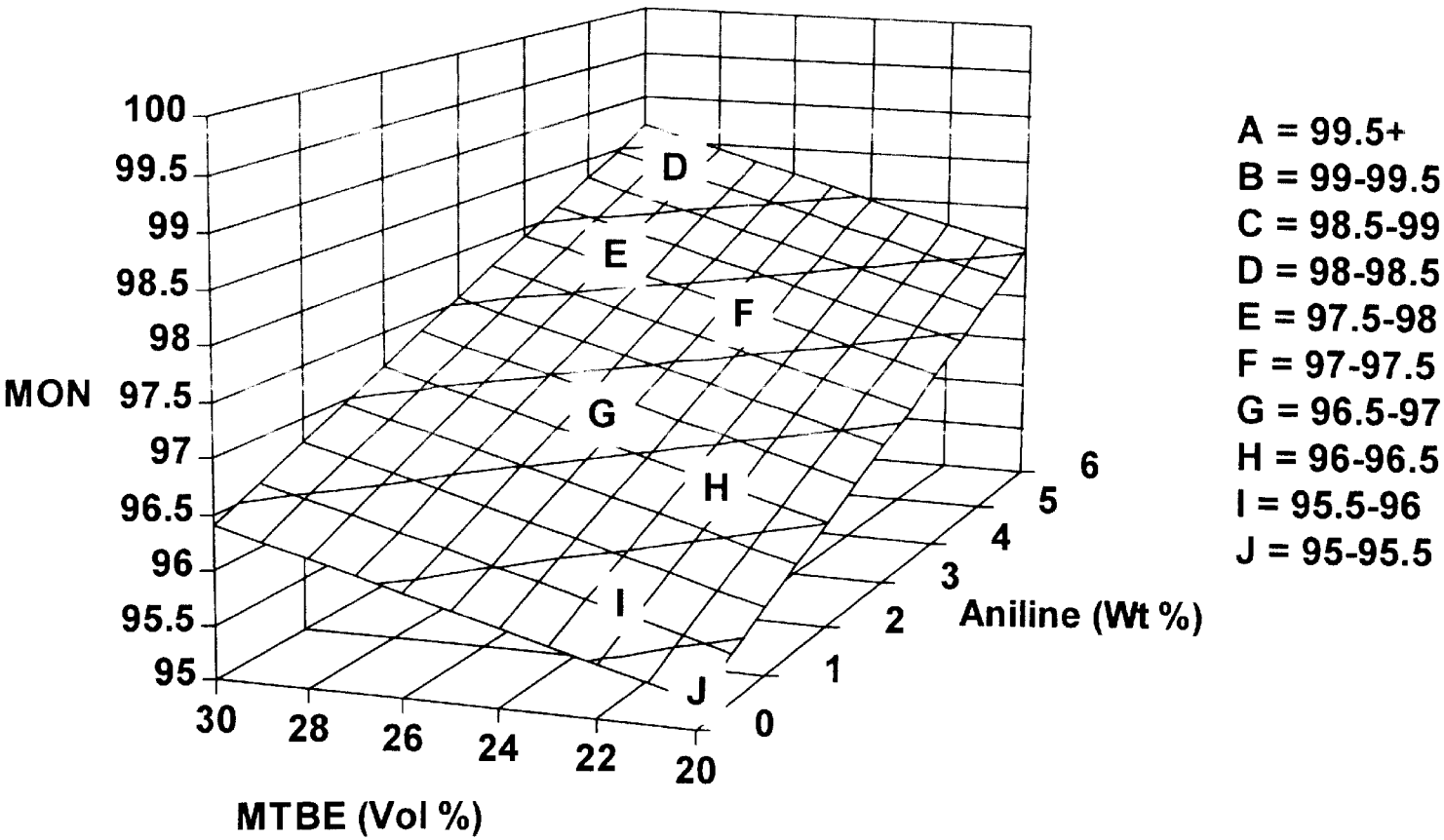
FIG. 28 is a model representing predicted MON as a function of concentration of MTBE and aniline at 0 g/gal manganese. This model is based on data from experiments as described in the Examples, Section E.
Figure 29:
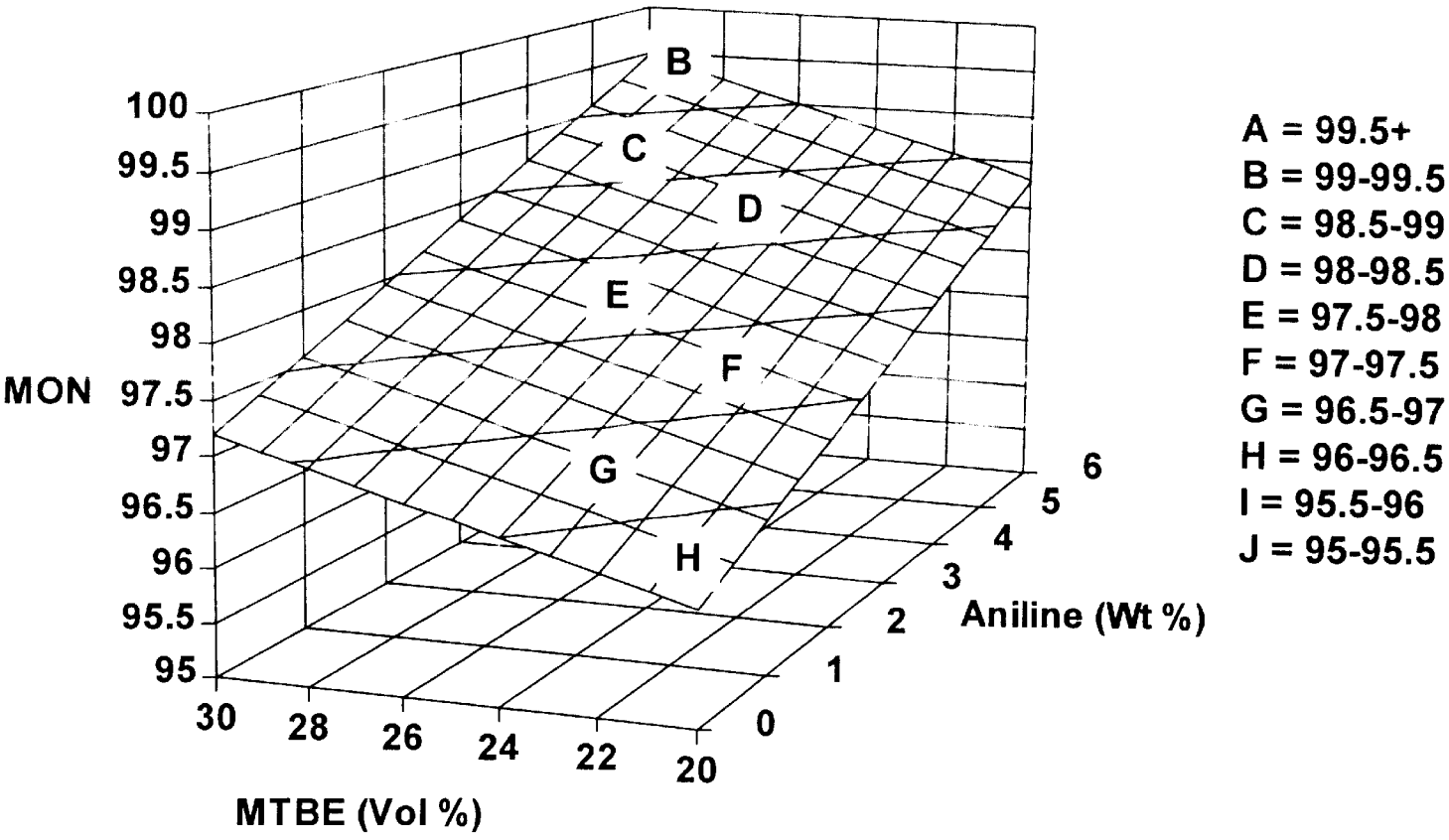
FIG. 29 is a model representing predicted MON as a function of concentration of MTBE and aniline at 0.05 g/gal manganese. This model is based on data from experiments as described in the Examples, Section E.
Figure 30:
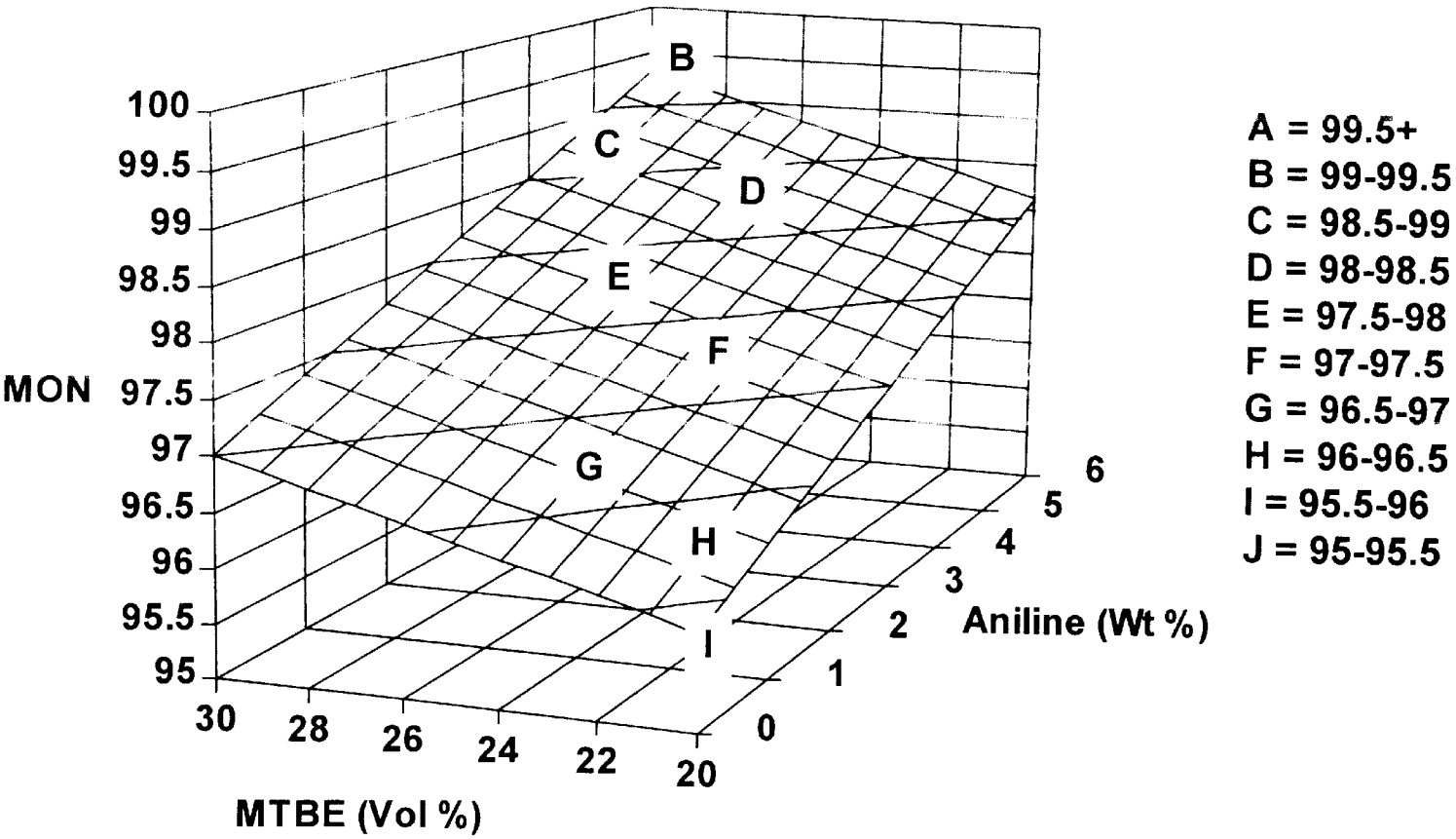
FIG. 30 is a model representing predicted MON as a function of the concentration of MTBE and aniline at 0.10 g/gal manganese. This model is based on data from experiments as described in the Examples, Section E.

D. Determination of Non-Linear Models for Identifying Aviation Fuel Compositions with Desirable MON Ratings The effects of various fuel formulations on MON ratings were determined using statistically designed experiments. More specifically, the complex relationships between the in-cylinder oxidation chemistries of the octane boosting additives and the basefuel were investigated using face centered cube statistical designs (See, e.g., FIG. 3).

The statistically designed experiments measured the MON values of specific fuel formulations which were combinations of three variables (Manganese level, aromatic amine level and oxygenate level) mixed with a wide boiling range alkylate. The three variables and their respective concentration ranges define the x, y and z axes of the cube. (See FIG. 3). The cube faces (surfaces) and the space within the cube define all the interaction points for investigation. The three variable test ranges were 0–10 wt % aromatic amine, 0–0.5 g/gal manganese (Mn) and 0–40 vol. % oxygenate (an alkyl tertiary butyl ether). The manganese may be provided by a corresponding amount of methyl cyclopentadienyl manganese tricarbonyl (MMT). The two oxygenates tested were methyl tertiary butyl ether (MTBE) and ethyl tertiary butyl ether (ETBE). In total, four test cubes were designed to measure the numerous fuel combinations and therefore potentially different chemical oxidation interactions. The four cube design layouts are listed in Table 4. Aniline and n-methyl aniline were the aromatic amines chosen for complete statistical analyses.

TABLE 4

Design for Testing Cube Independent Variables.

| Cube Number | Basefuel | Variable 1 | Variable 2 | Variable 3 |
|---|---|---|---|---|
| 1 | Wide boiling range | MMT | MTBE | Aniline |
| 2 | Wide boiling range | MMT | ETBE | Aniline |
| 3 | Wide boiling range | MMT | MTBE | n-Methyl Aniline |
| 4 | Wide boiling range | MMT | ETBE | n-Methyl Aniline |

The MON values were measured at specific points along the three cube axes as well as the cube center point. Multiple measurements were made at the center point to calculate the MON variation level with the assumption being it is constant over all the test space of the design, i.e. essentially a ten MON number range, 91–101. Polynomial curves were fitted to the data to define equations which describe the three variable interactions with respect to MON over the entire cube test space. From these equations, the MON performance for all variable combinations can be predicted within the test space defined by the maximum and minimum concentration ranges of the variables. Some of the predicted and measured MON values have been summarized in Tables 5–8. The remainder of the predicted values can be derived from the prediction equations.

TABLE 5

Predicted MON versus Measured MON for Oxygenate + Aniline Manganese = 0 g/gal

| | Aniline | | | | | | | |
|---|---|---|---|---|---|---|---|---|
| | 0 wt % | | 2 wt % | | 6 wt % | | 10 wt % | |
| | Vol. % | | | | | | | |
| | MON (p) | MON (m) | MON (p) | MON (m) | MON (p) | MON (m) | MON (p) | MON (m) |
| MTBE | | | | | | | | |
| 0 | 91.5 | 91.1 | 93.8 | 94.6 | 97.1 | | 98.6 | 98.8 |
| 10 | 92.8 | | 95.0 | | 98.0 | | 99.3 | |
| 20 | 93.8 | 93.6 | 95.8 | | 98.6 | 98.9 | 99.6 | |
| 30 | 94.4 | | 96.3 | | 98.8 | | 99.6 | |
| 40 | 94.7 | 95.2 | 96.5 | 97.0 | 98.7 | | 99.2 | 99.0 |
| ETBE | | | | | | | | |
| 0 | 92.3 | 91.1 | 93.8 | 95.9 | 96.8 | | 99.7 | 97.6 |
| 10 | 94.6 | | 95.9 | | 98.5 | | 101.1 | |
| 20 | 96.0 | 94.0 | 97.2 | | 99.4 | 98.8 | 101.7 | |
| 30 | 96.6 | | 97.5 | | 99.4 | | 101.3 | |
| 40 | 96.3 | 96.2 | 97.0 | 97.2 | 98.6 | | 100.1 | 101.1 |

TABLE 6

Predicted MON versus Measured MON for Oxygenate + Aniline Manganese = 0.5 g/gal

| | Aniline | | | | | | | |
|---|---|---|---|---|---|---|---|---|
| | 0 wt % | | 2 wt % | | 6 wt % | | 10 wt % | |
| | Vol. % | | | | | | | |
| | MON (p) | MON (m) | MON (p) | MON (m) | MON (p) | MON (m) | MON (p) | MON (m) |
| MTBE | | | | | | | | |
| 0 | 96.0 | 95.3 | 97.4 | 97.7 | 98.9 | | 98.7 | 99.1 |
| 10 | 97.3 | | 98.5 | | 99.8 | | 99.4 | |
| 20 | 98.2 | 99.1 | 99.4 | | 100.4 | 99.6 | 99.7 | |
| 30 | 98.9 | | 99.9 | | 100.6 | | 99.7 | |
| 40 | 99.2 | 100.3 | 100.1 | 99.6 | 100.6 | | 99.3 | 99.8 |
| ETBE | | | | | | | | |
| 0 | 95.5 | 95.5 | 95.9 | 96.0 | 96.8 | | 97.6 | 97.8 |
| 10 | 97.8 | | 98.0 | | 98.5 | | 99.0 | |
| 20 | 99.2 | 97.5 | 99.3 | | 99.4 | 100.5 | 99.5 | |
| 30 | 99.8 | | 99.6 | | 99.4 | | 99.2 | |
| 40 | 99.4 | 98.4 | 99.1 | 100.9 | 98.6 | | 98.0 | 97.1 |

TABLE 7

Predicted MON versus measured MON for Oxygenate + n-Methyl Aniline Manganese = 0.0 g/gal

| | n-Methyl Aniline | | | | | | | |
|---|---|---|---|---|---|---|---|---|
| | 0 wt % | | 2 wt % | | 6 wt % | | 10 wt % | |
| | Vol. % | | | | | | | |
| | MON (p) | MON (m) | MON (p) | MON (m) | MON (p) | MON (m) | MON (p) | MON (m) |
| MTBE | | | | | | | | |
| 0 | 92.1 | 91.1 | 93.4 | 94.0 | 95.0 | | 95.4 | 94.7 |
| 10 | 92.6 | | 93.7 | | 95.0 | | 95.0 | |

TABLE 7-continued

Predicted MON versus measured MON for Oxygenate + n-Methyl Aniline Manganese = 0.0 g/gal

| | n-Methyl Aniline | | | | | | | |
|---|---|---|---|---|---|---|---|---|
| | 0 wt % | | 2 wt % | | 6 wt % | | 10 wt % | |
| | Vol. % | | | | | | | |
| | MON (p) | MON (m) | MON (p) | MON (m) | MON (p) | MON (m) | MON (p) | MON (m) |
| 20 | 93.2 | 93.6 | 94.1 | | 95.0 | 94.9 | 94.6 | |
| 30 | 93.7 | | 94.5 | | 95.0 | | 94.2 | |
| 40 | 94.3 | 95.2 | 94.8 | 94.8 | 95.0 | | 93.9 | 94.6 |
| ETBE | | | | | | | | |
| 0 | 92.1 | 91.1 | 92.8 | 93.8 | 94.1 | | 95.4 | 95.6 |
| 10 | 93.3 | | 93.8 | | 94.6 | | 95.5 | |
| 20 | 94.5 | 94.0 | 94.7 | | 95.2 | 95.9 | 95.6 | |
| 30 | 95.7 | | 95.7 | | 95.7 | | 95.7 | |
| 40 | 96.9 | 96.2 | 96.6 | 96.2 | 96.2 | | 95.8 | 96.5 |

TABLE 8

Predicted MON versus measured MON for Oxygenate + n-Methyl Aniline, Manganese = 0.5 g/gal

| | n-Methyl Aniline | | | | | | | |
|---|---|---|---|---|---|---|---|---|
| | 0 wt % | | 2 wt % | | 6 wt % | | 10 wt % | |
| | Vol. % | | | | | | | |
| | MON (p) | MON (m) | MON (p) | MON (m) | MON (p) | MON (m) | MON (p) | MON (m) |
| MTBE | | | | | | | | |
| 0 | 97.2 | | 97.7 | 99.4 | 97.7 | | 96.4 | 95.9 |
| 10 | 97.7 | | 98.0 | | 97.7 | | 96.0 | |
| 20 | 98.3 | | 98.4 | | 97.7 | 97.5 | 95.6 | |
| 30 | 98.8 | | 98.8 | | 97.7 | | 95.3 | |
| 40 | 99.4 | | 99.1 | 98.7 | 97.7 | | 94.9 | 95.3 |
| ETBE | | | | | | | | |
| 0 | 96.6 | | 96.3 | 97.4 | 95.9 | | 95.5 | 95.9 |
| 10 | 97.1 | | 96.9 | | 96.4 | | 96.0 | |
| 20 | 97.6 | | 97.4 | | 96.9 | 97.2 | 96.5 | |
| 30 | 98.2 | | 97.9 | | 97.5 | | 97.0 | |
| 40 | 98.7 | | 98.5 | 97.3 | 98.0 | | 97.5 | 98.4 |

The equations which describe the three variable (oxygenate, Manganese and aromatic amine) interactions and ultimately predict MON levels are listed in Table 8A.

TABLE 8A

MON Prediction Equations

Test Cube: MTBE/Aniline/Manganese $$MON = 91.54 + (0.1466 \times MTBE) + (8.827 \times Mn) + (1.252 \times Aniline) - (0.006492 \times MTBE \times Aniline) - (0.8673 \times Mn \times Aniline) - (0.001667 \times MTBE^2) - (0.05437 \times Aniline^2)$$

Test Cube: MTBE/n-Methyl Aniline/Manganese $$MON = 92.06 + (0.05563 \times MTBE) + (10.23 \times Mn) + (0.7308 \times nMA) - (0.009273 \times MTBE \times nMA) - (0.8220 \times Mn \times nMA) - (0.04005 \times nMA^2)$$

TABLE 8A-continued

MON Prediction Equations

Test Cube: ETBE/Aniline/Manganese $$MON = 92.32 + (0.2730 \times ETBE) + (6.349 \times Mn) + (0.7429 \times Aniline) - (0.009016 \times ETBE \times Aniline) - (1.058 \times Mn \times Aniline) - (0.004362 \times ETBE^2)$$

Test Cube: ETBE/n-Methyl Aniline/Manganese $$MON = 92.12 + (0.1185 \times ETBE) + (17.04 \times Mn) + (0.3317 \times nMA) - (0.1306 \times ETBE \times Mn) - (0.01099 \times ETBE \times nMA) - (0.8828 \times Mn \times nMA) + (0.0218 \times ETBE \times Mn \times nMA) - (16.36 \times Mn^2)$$

The predicted MON variability for all four design cubes is a combination of engine measurement, fuel blending and equation fitting variability. Table 9 shows the MON engine measurement variability in terms of standard deviations for the four test cubes.

TABLE 9

Standard Deviations for Four Test Cubes.

| | | | |
|---|---|---|---|
| MTBE, Aniline, Mn | 0.70 MON | ETBE, Aniline, Mn | 0.28 MON |
| MTBE, n-Methyl Aniline, Mn | 0.60 MON | ETBE, n-Methyl Aniline, Mn | 0.55 MON |

The pooled standard deviations for the four test cubes is 0.614 with 18 degrees of freedom. At the 95% confidence limit this results in a variability of 1.83 MON. Variability, as used here, is defined as it is in ASTM MON rating method D-2700—for two single MON measurements, the maximum difference two numbers can have and still be considered equal. However, variability as used here is neither purely repeatability nor reproducibility, but is somewhere between the two definitions. All 168 test fuels were blended from the same chemical/refinery stocks and randomly MON rated by two operators on two MON rating engines over an 8 week period. The accuracy and variability for the equation fitting process of the MON data is shown in Table 10.

TABLE 10

Equation Fitting Variability

| Test Cube | $R^1$ Value | Root Mean Squared Error | Average Error |
|---|---|---|---|
| MTBE + Aniline | 91.0 | 0.82 | 0.54 |
| ETBE + Aniline | 74.5 | 1.29 | 0.88 |
| MTBE + n-Methyl Aniline | 77.3 | 0.99 | 0.70 |
| ETBE + n-Methyl Aniline | 81.3 | 0.81 | 0.61 |

The $R^2$ Values are the proportion of variability in the MON that is explained by the model over the ten octane number range tested. The fuel blending variability was not quantified but is not expected to be a major contributor to the overall predicted MON variability.

The majority of MON results were obtained while the aromatic amines were set in the statistical cube design as aniline and n-methyl aniline. Subsequent work was done to determine other potentially high octane aromatic amines. (See Tables 11–13.) Specific aromatic amines were substituted into two different blends; 1) 80 vol. % wide boiling range alkylate +20 vol. % MTBE and 2) 80 vol. % wide boiling range alkylate +20 vol. % ETBE. The substituted aromatic amines were blended at 2.0 wt %. No manganese was added to these blends. The MON results listed in Tables 11–13 are average MON of two tests.

TABLE 11

MON Values for Methyl Substitutions on Aniline Ring

| | 80/20 vol % Wide boiling range alkylate + MTBE | | 80/20 vol % Wide boiling range alkylate + ETBE | |
|---|---|---|---|---|
| aromatic amine | MON | dMON* | MON | dMON* |
| Aniline | 96.3 | — | 97.3 | — |
| o-toludidine | 94.5 | −1.8 | 95.2 | −2.1 |
| m-toluidine | 96.8 | 0.5 | 97.4 | 0.1 |
| p-toluidine | 96.8 | 0.5 | 96.8 | −0.5 |

*Note: dMON = delta MON = difference between additive of interest and Aniline reference point.

TABLE 12

MON Values for di- and tri- methyl substitutions on Aniline Ring

| | 80/20 vol % Wide boiling range alkylate + MTBE | | 80/20 vol % Wide boiling range alkylate + ETBE | |
|---|---|---|---|---|
| aromatic amine | MON | dMON* | MON | dMON* |
| Aniline | 96.3 | — | 97.3 | — |
| 2,3-dimethyl Aniline | 93.8 | −2.6 | 94.2 | −3.1 |
| 2,4-dimethyl Aniline | 95.0 | −1.3 | 95.2 | −2.1 |
| 2,5-dimethyl Aniline | 93.9 | −2.4 | 95.3 | −2.1 |
| 2,6-dimethyl Aniline | 93.3 | −3.0 | 93.4 | −3.9 |
| 3,5-dimethyl Aniline | 95.7 | −0.6 | 96.7 | −0.6 |
| 2,4,6-trimethyl Aniline | 92.6 | −3.8 | 93.7 | −3.6 |

TABLE 13

MON Values for Alkyl Substitutions on Aniline's Amine.

| | 80/20 vol % Wide boiling range alkylate + MTBE | | 80/20 vol % Wide boiling range alkylate + ETBE | |
|---|---|---|---|---|
| aromatic amine | MON | dMON* | MON | dMON* |
| Aniline | 96.3 | — | 97.3 | — |
| 4-ethyl Aniline | 96.1 | −0.3 | 97.5 | 0.2 |
| 4-n-butyl Aniline | 95.7 | −0.6 | 96.9 | −0.5 |
| n-methyl Aniline | 95.0 | −1.3 | 95.7 | −1.6 |
| n-ethyl Aniline | 91.9 | −4.4 | 91.9 | −5.4 |

It can be seen from Tables 11–13 that the aromatic amines which have a methyl substitution in the ortho- (or the 2 position) on the aromatic ring as well as the n-alkyl substitutions on the amine are not effective octane boosting additives for these two basefuels. However, the meta- ring position, (positions 3- and 5-) and the para- ring position, (position 4-) methyl substituted aromatic amines are generally more effective octane boosting additives for this basefuel with the exception of the p-toluidine in the ETBE/basefuel case. The relative. MON increasing effectiveness of the different alkyl substituted aromatic amines exemplifies the importance of mapping the chemical oxidation reaction routes for the additives of interest relative to the MON test environment. Further data from these experiments are shown in FIGS. 4–15.

E. Determination of Non-linear Models for Identifying Aviation Fuel Compositions with Desirable MON, Supercharge, and Knock Cycle/Intensity Ratings To better characterize the performance of fuel formulations, the effects of various fuel formulations on MON, Supercharge and Knock Cycle/Intensity ratings were determined using statistically designed experiments. The subject fuel compositions were combinations of MTBE, aniline and manganese components and the same wide boiling range alkylate fuel as the previous designs. The three variable test ranges for these experiments were 20–30 vol % MrBE, 0–6 wt % aniline and 0–0.1 g/gal manganese. Anti-knock ratings of MON, Supercharge and Knock Cycle/Intensity ratings were measured at least in duplicate.

Table 14 shows the non-linear interactions of the fuel composition components on the Supercharge rating and average Knocking Cycles and average Knock Intensity per 400 consecutive engine cycles data. The eight fuel formulations shown represent the extremes of the ranges tested.

Statistical analysis shows an interaction between the MTBE and manganese terms in the equations for supercharge rating but only when aniline levels are low with respect to the domain tested. There is another significant interaction for supercharge rating which is that as MTBE increases the interaction between manganese and aniline becomes antagonistic. Also, the data analysis for Knock Intensity contains an antagonistic interaction between MTBE and aniline. The Knocking Cycles data demonstrates a three way interaction between the MTBE, manganese and aniline.

TABLE 14

Measured Octane Parameters with respect to Fuel Formulation

| MTBE (vol %) | Mn (g/gal) | Aniline (wt %) | MON | Super-charge Rating | Average Knocking Cycles/400 | Average Knock Intensity/400 |
|---|---|---|---|---|---|---|
| 20 | 0.00 | 0 | 95.4 | 115.5 | 121 | 49 |
| 20 | 0.00 | 6 | 97.6 | 140.2 | 12 | 32 |
| 20 | 0.10 | 0 | 95.6 | 118.1 | 68 | 40 |
| 20 | 0.10 | 6 | 98.0 | 142.5 | 4 | 24 |
| 30 | 0.00 | 0 | 96.2 | 114.1 | 66 | 35 |
| 30 | 0.00 | 6 | 98.3 | 143.9 | 2 | 33 |
| 30 | 0.10 | 0 | 97.4 | 133.5 | 13 | 33 |
| 30 | 0.10 | 6 | 99.3 | 144.5 | 2 | 20 |

Because of the above mentioned non-linear fuel composition interactions, neither MON nor supercharge ratings when considered individually will always predict the knock-free operation of the commercial Lycoming IO-360 aviation engine. (See Table 15). The Knocking Cycle and Knock intensity data in Table 15 are the average of duplicate 400 cycle tests.

TABLE 15

Measured Octane Parameters with respect to Fuel Formulation (II)

| Fuel Number | MON | Supercharge Rating | Average Knocking Cycles/400 | Average Knock Intensity/400 |
|---|---|---|---|---|
| 1 | 98.4 | 134.9 | 17 | 30 |
| 2 | 98.5 | 142.2 | 0 | 0 |
| 3 | 96.5 | 136.1 | 0 | 0 |
| 4 | 96.3 | 115.1 | 73 | 35 |

The $R^2$ values between MON, Supercharge, Knocking Cycles and Knock Intensity are listed in Table 16.

TABLE 16

$R^2$ values for Knocking Cycles and Knock Intensity Predictions

| Combination | $R^2$ values |
|---|---|
| MON to predict Knocking Cycles* | .44 |
| MON to predict Knock Intensity* | .38 |
| Supercharge to predict Knocking | .64 |
| Supercharge to predict Knock Intensity* | .82 |

Notes:*Outlying data points that were not representative of population were removed after statistical analyses.

Table 17 includes the references of pure isooctane as well as the industry standard leaded Avgas 100 Low Lead. For example, pure isooctane has a MON value of 100 by definition but knocks severely in the Lycoming IO-360 at its maximum potential knock operating condition. Addition of tetraethyllead (TEL) to isooctane is required to boost the supercharge rating sufficiently high to prevent auto-ignition in a commercial aircraft engine.

TABLE 17

Knock Data for Isooctane and Leaded Avgas 100 Low Lead

| Fuel | MON | Supercharge Rating | Knocking Cycles/400 | Knock Intensity/400 |
|---|---|---|---|---|
| Isooctane | 100 | 100 | 85 | Not Collected |
| 100 Low Lead | 105 | 131.2 | 0 | 0 |

Using centered & scaled units for the fuel properties our equation for MON is:

$$MON=97.75+0.575*MTBE(s)+0.305*Mn(s)+1.135*Aniline(s)-0.485*Mn(s)^2.$$

Converting to actual units yields:

$$MON=92.95+0.115*MTBE+25.5*Mn+0.3783*Aniline-194*Mn^2.$$

No interactions were statistically significant.

Using centered & scaled units for the fuel properties our equation for supercharge (SC) is:

$$SC= 140.008 + 2.325*MTBE(s) + 3.9*Mn(s) + 11.715*Aniline(s) + 1.89375*MTBE(s)*Mn(s) - 2.39375*Mn(s)*Aniline(s) - 2.30625*MTBE(s)*Mn(s)*Aniline(s) - 8.653*Aniline(s)^2.$$

Converting to actual units yields:

$$SC = 122.72 - 0.375*MTBE - 294.125*Mn + 6.628*Aniline + 16.8*MTBE*Mn + 0.15375*MTBE*Aniline + 60.917*Mn*Aniline - 3.075*MTBE*Mn*Aniline - 0.9614815*Aniline^2$$

Looking at the equation in centered and scaled units, we see that the interaction between MTBE and Mn is synergistic (coefficient same sign as coefficients for individual effects of MTBE * Mn). But, because of the presence of the 3-way interaction between MTBE, Mn, and Aniline, the size of the MTBE*Mn interaction actually depends on the level of aniline. At the low level of aniline, the MTBE*Mn interaction is synergistic, but as the aniline level increases, the MTBE*Mn interaction becomes less and less synergistic until it becomes basically zero at the high aniline level (if anything, it is antagonistic at this point). Thus, there is a synergism between MTBE and Mn, but generally only at low levels of aniline.

A similar description can be used for the Mn*Aniline interaction, where the size of this interaction depends on the MTBE level. At low levels of MTBE, the Mn*Aniline interaction is essentially zero, but as the MTBE level increases the Mn*Aniline interaction becomes more and more antagonistic. Table 18 below illustrates the above concepts.

TABLE 18

| MTBE (vol %) | Mn (g/gal) | Aniline (wt %) | Actual SC | Predicted SC | Expected SC[1] |
|---|---|---|---|---|---|
| 20 | 0.00 | 0 | 122.2, 108.7 | 115.2 | |
| 20 | 0.10 | 0 | 116.8, 119.4 | 119.4 | |
| 30 | 0.00 | 0 | 113.0, 115.1 | 111.5 | |
| 30 | 0.10 | 0 | 132.1, 134.9 | 132.5 | 115.7 |
| 20 | 0.00 | 6 | 137.6, 142.8 | 138.8 | |
| 20 | 0.10 | 6 | 142.7, 142.8 | 142.7 | |
| 30 | 0.00 | 6 | 143.8, 143.9 | 144.3 | |
| 30 | 0.10 | 6 | 143.9, 145.1 | 146.5 | 148.2 |

[1]This is the expected SC value if there was no interaction, that is if the effects of each of the fuel components were additive.

Using centered and scaled units for the fuel properties our equation for Knock Intensity (KInt) is:

$$KInt=26.5-2.138719*MTBE(s)-1.905819*Mn(s)-5.877127*Aniline(s)$$

$$+2.477696*MTBE(s)*Aniline(s)+2.711142*Mn(s)^2+2.780729*Aniline(s)^2$$

Converting to actual units yields:

$$KInt=62.9-0.923283*MTBE-146.56206*Mn-7.9423549*Aniline$$

$$+0.1651797*MTBE*Aniline+1084.4568*Mn^2+0.3089699*Aniline^2$$

Again looking at the equation in the centered and scaled units, we see that the MTBE*Aniline interaction is antagonistic. Also, note that this interaction does not depend on the Mn level because there is no 3-way interaction in the model. The following Table 19 illustrates this action.

TABLE 19

| MTBE (vol %) | Mn (g/gal) | Aniline (wt %) | Actual Knock Int. | Predicted Knock Int. | Expected Knock Int.[1] |
|---|---|---|---|---|---|
| 20 | 0.00 | 0 | 52.0, 48.1, 38.0 | 44.4 | |
| 20 | 0.00 | 6 | 36.1, 27.3, 26.0 | 27.7 | |
| 30 | 0.00 | 0 | 34.4, 35.3 | 35.2 | |
| 30 | 0.00 | 6 | 25.7, 40.0 | 28.4 | 18.5 |
| 20 | 0.10 | 0 | 39.4, 40.9, 38.7 | 40.6 | |
| 20 | 0.10 | 6 | 19.0, 28.4, 19.0 | 23.9 | |
| 30 | 0.10 | 0 | 37.6, 30.0, 28.0 | 31.4 | |
| 30 | 0.10 | 6 | 21.0, 19.0 | 24.6 | 14.7 |

[1]This is the expected Knock Intensity value if there was no interaction, that is if the effects of each of the fuel components were additive.

It should be pointed out that knock intensity values below 20 cannot be distinguished from each other, so the antagonistic effect of the MTBE*Aniline interaction may not be quite so significant at the high level of Mn (since the expected value under the assumption of no interaction is 14.7 and the actual values were 21.0 & 19.0).

Using centered and scaled units for the fuel properties, our equation for number of Knocking Cycles (Cycles) is:

$$Y = \ln(\text{Cycles} + 1) = 1.529878 - 0.43339*\text{MTBE(s)} - 0.376319*\text{Mn(s)} - 1.469152*\text{Aniline(s)} + 0.368344*\text{MTBE(s)}*\text{Mn(s)}*\text{Aniline(s)} + 0.732549*\text{Aniline(s)}^2.$$

Converting to actual units yields:

$$Y = \ln(\text{Cycles} + 1) = 4.4331281 - 0.0130092*\text{MTBE} + 29.308018*\text{Mn} - 0.3641767*\text{Aniline} - 1.4733759*\text{MTBE}*\text{Mn} - 0.0245563*\text{MTBE}*\text{Aniline} - 12.278133*\text{Mn}*\text{Aniline} + 0.4911253*\text{MTBE}*\text{Mn}*\text{Aniline} + 0.0813943*\text{Aniline}^2.$$

In either case, the predicted number of knocking cycles is equal to $e^y-1$.

This variable was analyzed on the natural log (ln) scale because it was observed that the variability was a function of mean level. Analyzing the data on the In scale causes the variability to be more constant across mean levels, which is necessary for the statistical tests performed to be valid. Also, since some observations had values of zero for number of knocking cycles (the natural log of zero cannot be calculated), 1 was added to every observation so that the ln transformation could be used. Thus, 1 must be subtracted from Y above to get back to the original units.

Because of the presence of the 3-way interaction in the model and no 2-way interactions, the 3-way interaction can be interpreted in 3 ways. We could say that there is a synergistic interaction between MTBE & Mn at low levels of aniline and an antagonistic interaction at high levels of aniline. This description holds for all pairs of fuel properties.

The following Table 20 describes the MTBE*Mn interaction being synergistic at low levels of aniline and being antagonistic at high levels of aniline

TABLE 20

| MTBE (vol %) | Mn (g/gal) | Aniline (wt %) | Avg. # of Knocking Cycles | Pred. # of Knocking Cycles | Expected # of Knocking Cycles[1] |
|---|---|---|---|---|---|
| 20 | 0.00 | 0 | 178.5, 93.0, 28.0 | 63.9 | |
| 20 | 0.10 | 0 | 78.5, 48.0, 71.5 | 62.9 | |
| 30 | 0.00 | 0 | 56.5, 73.0 | 56.0 | |
| 30 | 0.10 | 0 | 17.0, 0.8, 17.0 | 11.9 | 55.1 |
| 20 | 0.00 | 6 | 13.0, 15.5, 0.5 | 6.2 | |
| 20 | 0.00 | 6 | 0.0, 5.5, 0.0 | 0.6 | |
| 30 | 0.00 | 6 | 1.5, 0.5 | 0.4 | |
| 30 | 0.10 | 6 | 1.0, 0.0 | 0.4 | 0.0 |

[1]This is the expected avg. # of knocking cycles value if there was no interaction, that is if the effects of each of the fuel components were additive.

Note that at the high aniline level, the reason for the antagonistic MTBE*Mn interaction is that the number of knocking cycles cannot be reduced to a value lower than zero. Increasing Mn to 0.01 lowers the number of knocking cycles to almost zero and increasing MTBE to 30 also lowers the number of knocking cycles to almost zero. Therefore, increasing both Mn and MTBE at the same time cannot reduce the number of knocking cycles any more.

Using centered and scaled units for the fuel properties our equation for # of Knocking Cycles is:

$$\text{Cycles} = 4.462241 - 9.166427*\text{MTBE(s)} - 7.93772*\text{Mn(s)} - 26.077604*\text{Aniline(s)} + 8.742241*\text{MTBE(s)}*\text{Aniline(s)} + 8.491223*\text{Mn(s)}*\text{Aniline(s)} + 5.167309*\text{MTBE(s)}*\text{Mn(s)}*\text{Aniline(s)} + 24.483337*\text{Aniline(s)}^2.$$

Converting to actual units yields:

$$\text{Cycles} = 135.2 - 2.5482718*\text{MTBE} + 188.15204*\text{Mn} - 33.803388*\text{Aniline} - 20.669236*\text{MTBE}*\text{Mn} + 0.2383288*\text{MTBE}*\text{Aniline} - 115.63548*\text{Mn}*\text{Aniline} + 6.8897453*\text{MTBE}*\text{Mn}*\text{Aniline} + 2.7203708*\text{Aniline}^2.$$

In this case, the only synergistic interaction is between MTBE and Mn at low aniline levels. All other interactions are antagonistic. The MTBE*Mn synergism at low aniline levels and antagonism at high aniline levels is shown below in Table 21.

TABLE 21

| MTBE (vol %) | Mn (g/gal) | Aniline (wt %) | Avg. # of Knocking Cycles | Pred. # of Knocking Cycles | Expected # of Knocking Cycles[1] |
|---|---|---|---|---|---|
| 20 | 0.00 | 0 | 178.5[2], 93.0, 28.0[2] | 84.2 | |
| 20 | 0.10 | 0 | 78.5, 45.0, 71.5 | 61.7 | |
| 30 | 0.00 | 0 | 56.5, 73.0 | 58.7 | |
| 30 | 0.10 | 0 | 17.0, 0.8, 17.0 | 15.5 | 36.2 |
| 20 | 0.00 | 6 | 13.0, 15.5, 0.5 | 7.9 | |
| 20 | 0.10 | 6 | 0.0, 5.5, 0.0 | 0.0 | |
| 30 | 0.00 | 6 | 1.5, 0.5 | 0.0 | |
| 30 | 0.10 | 6 | 1.0, 0.0 | 8.2 | 0.0 |

[1]This is the expected avg. # of knocking cycles value if there was no interaction, that is if the effects of each of the fuel components were additive.
[2]These observations were not included in the analyses.

Further data from these experiments are shown in FIGS. 16–30.

The testing and equation fitting variability of the second set of experimentally designed cubes is demonstrated in Tables 22 and 23. For the predicted performance parameter listed in Table 22, the 95% total variability is a combination of engine measurement and fuel blending variabilities. Table 22 also shows the performance parameter engine measurement and fuel blending variability in terms of standard deviation and total variability calculated at the 95% confidence limit.

TABLE 22

Variability Analysis for Second Cube Sets

| Performance Parameter | Standard Deviation | 95% Total Variability |
|---|---|---|
| MON | 0.69 | 2.07 |
| Performance Number | 3.93 | 11.73 |
| Knock Intensity | 7.04 | 19.70 |
| Knocking Cycles (In Scale) | 1.15 | 3.27 |
| Knocking (linear Scale) | 18.6 | 52.60 |

Total variability, as used here, is defined as it is in ASTM Methods—for two single measurements, the maximum difference two numbers can have and still be considered equal. However, variability as used here is neither purely repeatability nor reproducibility, but is somewhere between the two definitions. The accuracy and variability for the equation fitting process of the performance parameters is shown in Table 23.

TABLE 23

Equation Fitting Variability for Second Cube Set

| Performance Parameter | $R^2$ Value | Root Mean Squared Error | Average Error |
|---|---|---|---|
| MON | 76.8 | 0.63 | 0.47 |
| Performance Number | 91.2 | 3.99 | 2.50 |
| Knock Intensity | 60.5 | 5.40 | 3.80 |
| Knocking Cycles (in small "L" Scale) | 74.2 | 0.83 | 0.60 |
| Knocking Cycles (linear Scale) | 89.1 | 9.30 | 7.10 |

Other features, advantages and embodiments of the invention disclosed herein will be readily apparent to those exercising ordinary skill after reading the foregoing disclosure. In this regard, while specific embodiments of the invention have been described in detail, variations and modifications of these embodiments can be effected without departing from the spirit and scope of the invention as described and claimed.

What is claimed is:

1. An unleaded aviation fuel composition comprising:

(1) an unleaded alkylate base fuel having a boiling point range that is substantially wider than the range of boiling points in an aviation alkylate base fuel and having a MON of at least 91; and (2) a substantially positive or synergistic combination of
(a) an alkyl tertiary butyl ether, and
(b) an aromatic amine having the formula

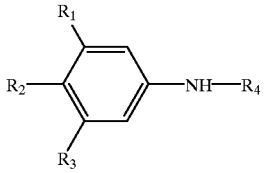

wherein $R_1$, $R_2$, $R_3$ and $R_4$ are hydrogen or a $C_1$–$C_3$ alkyl group, wherein the alkyl tertiary butyl ether and aromatic amine are added in an amount sufficient to raise the motor octane number of the composition to at least 94.

2. The composition of claim 1, wherein the basefuel is an automotive alkylate basefuel.

3. The composition of claim 1, wherein the alkyl tertiary butyl ether is methyl tertiary butyl ether.

4. The composition of claim 1, wherein the alkyl tertiary butyl ether is ethyl tertiary butyl ether.

5. The composition of claim 1, wherein the aromatic amine is aniline.

6. The composition of claim 1, wherein $R_1$, $R_2$, $R_3$ or $R_4$ is methyl.

7. The composition of claim 1, wherein the aromatic amine is n-methyl aniline, n-ethyl aniline, m-toluidine, p-toluidine, 3,5-dimethyl aniline, 4-ethyl aniline or 4-n-butyl aniline.

8. The composition of claim 1, wherein the composition further comprises manganese.

9. The composition of claim 8, wherein the manganese is provided by methyl cyclopentadienyl manganese tricarbonyl.

10. The composition of claim 1, wherein the composition comprises 0.1 to 40 vol % alkyl tertiary butyl ether and 0.1 to 10 wt % aromatic amine.

11. The composition of claim 1, wherein the composition comprises 15 to 32 vol % methyl tertiary butyl ether and 1.5 to 6 wt % aniline.

12. The composition of claim 1, wherein the composition comprises 15 to 32 vol % ethyl tertiary butyl ether and 1.5 to 6 wt % aniline.

13. The composition of claim 10, wherein the composition further comprises manganese in an amount from 0.1 to 0.5 g per gal of the composition.

14. The composition of claim 1, wherein the MON of the composition is at least 96.

15. The composition of claim 1, wherein the MON of the composition is at least 98.

16. The composition of claim 11, wherein the composition further comprises manganese in an amount from 0.1 to 0.5 g per gal of the composition.

17. The composition of claim 12, wherein the composition further comprises manganese in an amount from 0.1 to 0.5 g per gal of the composition.

18. A method for operating a piston driven aircraft which comprises operating the aircraft engine with the aviation fuel composition of claim 1.

19. A method for operating a piston driven aircraft which comprises operating the aircraft engine with the aviation fuel composition of claim 10.

20. A method for preparing a composition comprising combining (i) an unleaded alkylate base fuel having a boiling point range that is substantially wider than the range of boiling points in an aviation alkylate base fuel and having a motor octane number of at least 91, and (ii) a synergistic amount of alkylate tertiary butyl ether and an aromatic amine sufficient to raise the motor octane number of the composition to at least 94.

* * * * *